US010270161B2

(12) United States Patent
Sonoda et al.

(10) Patent No.: US 10,270,161 B2
(45) Date of Patent: Apr. 23, 2019

(54) ANTENNA DEVICE AND WIRELESS APPARATUS INCLUDING SAME

(71) Applicant: AGC Inc., Chiyoda-ku (JP)

(72) Inventors: Ryuta Sonoda, Chiyoda-ku (JP); Koji Ikawa, Chiyoda-ku (JP); Toshiki Sayama, Chiyoda-ku (JP)

(73) Assignee: AGC Inc., Chiyoda-ku (JP)

( * ) Notice: Subject to any disclaimer, the term of this patent is extended or adjusted under 35 U.S.C. 154(b) by 201 days.

(21) Appl. No.: 14/600,163

(22) Filed: Jan. 20, 2015

(65) Prior Publication Data

US 2015/0130669 A1 May 14, 2015

Related U.S. Application Data

(63) Continuation of application No. PCT/JP2013/067135, filed on Jun. 21, 2013.

(30) Foreign Application Priority Data

Jul. 20, 2012 (JP) ..... 2012-161983

(51) Int. Cl.

| | |
|---|---|
| ***H01Q 1/50*** | (2006.01) |
| ***H01Q 7/00*** | (2006.01) |
| ***H01Q 9/06*** | (2006.01) |
| ***H01Q 5/378*** | (2015.01) |
| *H01Q 9/42* | (2006.01) |
| *H01Q 1/24* | (2006.01) |
| *H01Q 21/28* | (2006.01) |
| *H01Q 5/364* | (2015.01) |

(52) U.S. Cl.

CPC ..... *H01Q 1/50* (2013.01); *H01Q 5/378* (2015.01); *H01Q 7/00* (2013.01); *H01Q 9/065* (2013.01); *H01Q 1/243* (2013.01); *H01Q 5/364* (2015.01); *H01Q 9/42* (2013.01); *H01Q 21/28* (2013.01)

(58) Field of Classification Search

CPC ..... H01Q 1/50; H01Q 5/378; H01Q 7/00; H01Q 9/065

USPC ..... 343/702

See application file for complete search history.

(56) References Cited

U.S. PATENT DOCUMENTS

| | | | |
|---|---|---|---|
| 5,760,745 | A | 6/1998 | Endo et al. |
| 6,342,856 | B1 | 1/2002 | Nakano et al. |
| 7,106,256 | B2 | 9/2006 | Watanabe et al. |

(Continued)

FOREIGN PATENT DOCUMENTS

| | | | |
|---|---|---|---|
| CN | 101106211 | A | 1/2008 |
| CN | 101595598 | A | 12/2009 |

(Continued)

OTHER PUBLICATIONS

U.S. Appl. No. 14/747,178, filed Jun. 23, 2015, Sonoda, et al.

(Continued)

*Primary Examiner* — Jessica Han
*Assistant Examiner* — Jae K Kim
(74) *Attorney, Agent, or Firm* — Oblon, McClelland, Maier & Neustadt, L.L.P.

(57) ABSTRACT

An antenna device includes a feeding element connected to a feed point, and a radiating element disposed at a distance from the feeding element. The feeding element is coupled with the radiating element by electromagnetic field coupling to feed the radiating element so that the radiating element functions as a radiating conductor.

20 Claims, 28 Drawing Sheets

(56) References Cited

U.S. PATENT DOCUMENTS

| | | | | |
|---|---|---|---|---|
| 7,176,837 | B2 | 2/2007 | Sonoda et al. | |
| 7,365,685 | B2 | 4/2008 | Takeuchi et al. | |
| 2004/0046699 | A1 | 3/2004 | Amano et al. | |
| 2004/0066341 | A1 | 4/2004 | Ito et al. | |
| 2004/0140934 | A1 | 7/2004 | Korva | |
| 2005/0052334 | A1 | 3/2005 | Ogino et al. | |
| 2005/0099335 | A1 | 5/2005 | Chung et al. | |
| 2006/0119517 | A1 | 6/2006 | Futamata | |
| 2006/0145923 | A1 | 7/2006 | Autti | |
| 2007/0046542 | A1 | 3/2007 | Andrenko et al. | |
| 2009/0221243 | A1 | 9/2009 | Egawa et al. | |
| 2010/0097191 | A1 | 4/2010 | Yamagajo et al. | |
| 2010/0201597 | A1 | 8/2010 | Okui et al. | |
| 2010/0253581 | A1* | 10/2010 | Tsou | H01Q 1/38 343/702 |
| 2011/0234462 | A1* | 9/2011 | Aoki | H01Q 1/243 343/702 |
| 2013/0120198 | A1 | 5/2013 | Maeda et al. | |

FOREIGN PATENT DOCUMENTS

| | | |
|---|---|---|
| CN | 102265457 A | 11/2011 |
| JP | 02-000811 U | 1/1990 |
| JP | 8-330827 | 12/1996 |
| JP | 11-205028 | 7/1999 |
| JP | 2000-286625 | 10/2000 |
| JP | 2001-244715 | 9/2001 |
| JP | 2004-104502 | 4/2004 |
| JP | 2005-020228 | 1/2005 |
| JP | 2005-236656 | 9/2005 |
| JP | 2006-270395 | 10/2006 |
| JP | 2007-67543 | 3/2007 |
| JP | 2009-060268 | 3/2009 |
| JP | 2010-206772 | 9/2010 |
| WO | WO 2012/008177 | 1/2012 |

OTHER PUBLICATIONS

U.S. Appl. No. 14/790,472, filed Jul. 2, 2015, Sonoda, et al.

International Search Report dated Sep. 17, 2013 for PCT/JP2013/067135 filed Jun. 21, 2013.

A. Kurs et al., "Wireless Power Transfer via Strongly Coupled Magnetic Resonances", Science Express, vol. 317, No. 5834, Jul. 2007, pp. 83-86.

Extended European Search Report dated Feb. 18, 2016 in Patent Application No. 13819537.5.

* cited by examiner

ANTENNA DEVICE AND WIRELESS APPARATUS INCLUDING SAME

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2013/067135, filed on Jun. 21, 2013, which is based on and claims the benefit of priority of Japanese Patent Application No. 2012-161983 filed on Jul. 20, 2012, the entire contents of which are incorporated herein by reference.

BACKGROUND OF THE INVENTION

1. Field of the Invention

An aspect of this disclosure relates to an antenna device and a wireless apparatus including the antenna device.

2. Description of the Related Art

In recent years, the number of antennas provided in, for example, a portable wireless apparatus has increased and the integration density of a circuit board of such a portable wireless apparatus has increased. For this reason, antennas are disposed, for example, on or in a housing of a portable wireless apparatus away from a circuit board.

For example, Japanese Laid-Open Patent Publication No. 2009-060268 discloses an antenna conductor (radiating conductor) that is formed on an outer surface of a housing, and is in physical contact with a feed pin provided on a circuit board (see FIG. 2 of Japanese Laid-Open Patent Publication No. 2009-060268). When such a feed pin is used, to improve the reliability of a connection in a case where an external impact is applied, a special connection terminal such as a spring-pin connector having a mechanism to reduce the impact is used. Also, Japanese Laid-Open Patent Publication No. 2001-244715 discloses a feeding mechanism as an example where such a special mechanism is not used.

Japanese Laid-Open Patent Publication No. 2001-244715 discloses an antenna device where a radiating conductor is formed on a housing, and a capacitor plate is disposed at an end of an upright feeder line on a circuit board (see FIG. 1 of Japanese Laid-Open Patent Publication No. 2001-244715). The capacitor plate and the radiating conductor are capacitively coupled, and power is fed to the radiating conductor in a non-contact manner. This non-contact feeding mechanism is resistant to an impact. In a case where a brittle material such as glass or ceramics is used for a housing on which antennas are formed and a feed pin is used for feeding, the housing may be damaged and the antennas may become inoperable when a strong external impact is applied to the housing and stress is concentrated on one point on the housing. A non-contact feeding mechanism is very effective to prevent such problems.

However, with a feeding mechanism where a radiating conductor and a capacitor plate are capacitively coupled, its capacitance value greatly varies when the positional relationship between the radiating conductor and the capacitor plate, particularly a gap between them, becomes different from a designed value due to, for example, a production error. This in turn makes it difficult to achieve impedance matching. Also, the same problem may occur when the positional relationship between the radiating conductor and the capacitor plate changes due to vibration during use.

SUMMARY OF THE INVENTION

An aspect of this disclosure provides an antenna device including a feeding element connected to a feed point, and a radiating element disposed at a distance from the feeding element. The feeding element is coupled with the radiating element by electromagnetic field coupling to feed the radiating element so that the radiating element functions as a radiating conductor.

DESCRIPTION OF THE EMBODIMENTS

Embodiments of the present invention are described below with reference to the accompanying drawings.

Figure 1A:
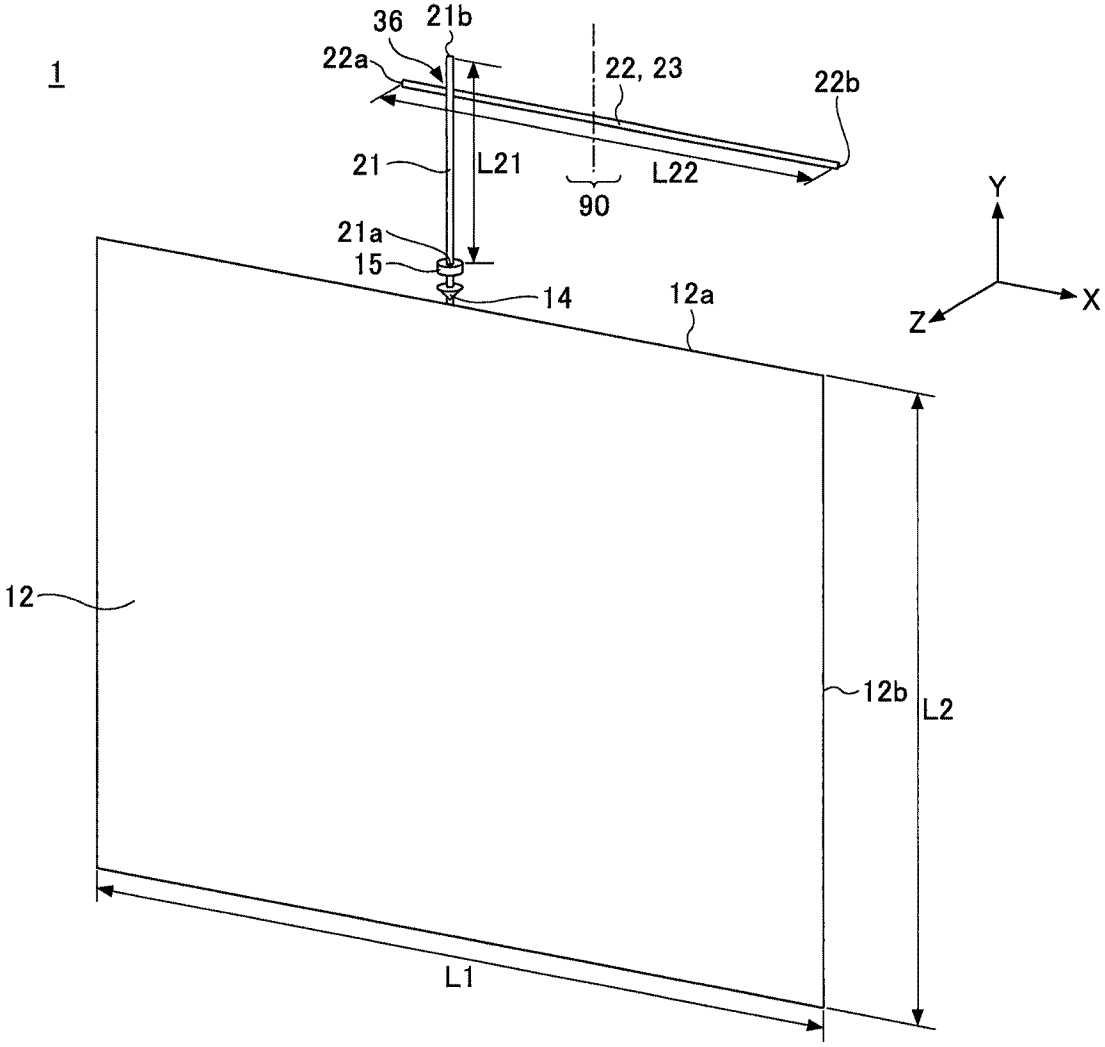
FIG. 1A is a perspective view of an analytic model of an antenna device according to an embodiment.

FIG. 1A is a perspective view of a computer simulation model for analyzing operations of an antenna device 1 according to an embodiment of the present invention. Microwave Studio (registered trademark) (CST Computer Simulation Technology AG) is used as an electromagnetic field simulator.

The antenna device 1 includes a feed point 14, a ground plane 12, a radiating element 22, a feeding part 36 for feeding the radiating element 22, and a feeding element 21 that is a conductor and disposed at a predetermined distance from the radiating element 22 in a Z-axis direction. The feeding part 36 is a feeding part solely for the radiating element 22, and is not for the antenna device 1. A feeding part for the antenna device 1 is the feed point 14.

In the example of FIG. 1A, the radiating element 22 and the feeding element 21 overlap each other in plan view seen from the Z-axis direction. However, the radiating element 22 and the feeding element 21 do not necessarily overlap each other in plan view seen from the Z-axis direction, as long as the feeding element 21 and the radiating element 22 are at such a distance from each other that they can be coupled by electromagnetic field coupling. For example, the feeding element 21 and the radiating element 22 may overlap each other in plan view seen from any direction such as an X-axis direction or a Y-axis direction.

The radiating element 22 is a line-shaped antenna conductor that extends along an edge 12*a* of the ground plane 12. For example, the radiating element 22 is a linear conductor including a conductor part 23 that is at a predetermined shortest distance from the edge 12*a* in the Y-axis direction and extends parallel to the edge 12*a* in the X-axis direction. With the radiating element 22 including the conductor part 23 extending along the edge 12*a*, it is possible, for example, to easily control the directivity of the antenna device 1. In the example of FIG. 1A, the radiating element 22 has a line shape. However, the radiating element 22 may have any other shape such as an L-shape.

The feeding element 21 is connected to the feed point 14 that uses the ground plane 12 as a ground reference, and is a linear conductor that can feed the radiating element 22 by electromagnetic field coupling via the feeding part 36. In the example of FIG. 1A, the feeding element 21 is a linear conductor that extends linearly in the Y-axis direction from an end 21*a* connected to the feed point 14 to an end 21*b*. The end 21*b* is an open end to which no conductor is connected.

The feed point 14 is a feeding part connected, for example, to a transmission line using the ground plane 12 or a feeding line. Examples of transmission lines include a microstrip line, a strip line, and a coplanar waveguide with a ground plane (i.e., a coplanar waveguide including a ground plane disposed on a surface opposite to a conductor surface). Examples of feeding lines include a feeder line and a coaxial cable.

The feeding element 21 is connected via the feed point 14 to, for example, a feeding circuit (e.g., an integrated circuit such as an IC chip) mounted on a circuit board. The feeding element 21 may also be connected to the feeding circuit via different types of transmission lines and/or feeding lines as described above. The feeding element 21 feeds the radiating element 22 by electromagnetic field coupling.

FIG. 1A exemplifies the ground plane 12 having a rectangular shape and extends in an XY plane. FIG. 1A also exemplifies the feeding element 21 that is a linear conductor extending in a direction perpendicular to the edge 12*a* of the ground plane 12 and parallel to the Y-axis, and the radiating part 22 that is a linear conductor extending in a direction perpendicular to the direction in which the feeding element 21 extends and parallel to the X-axis.

Figure 1B:
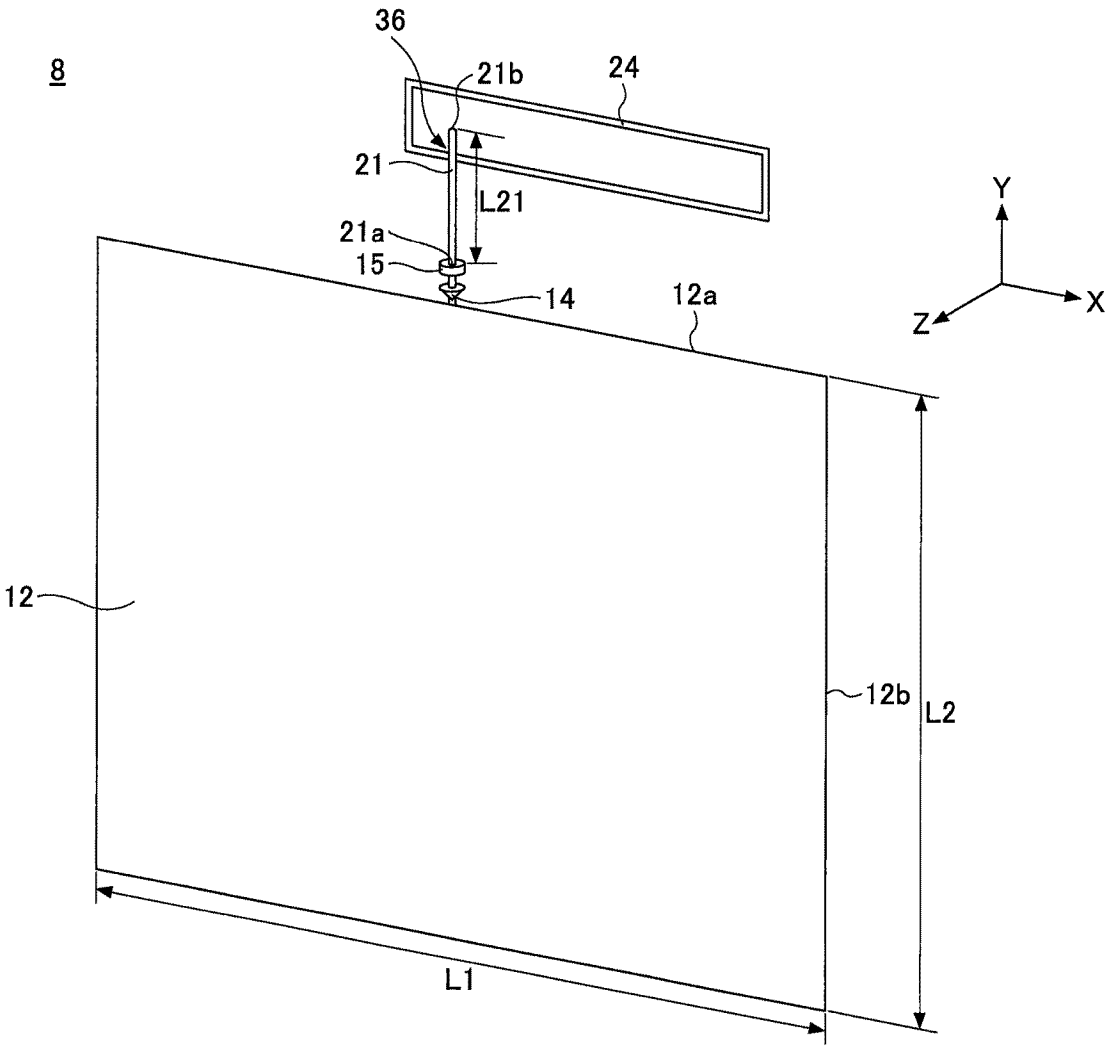
FIG. 1B is a perspective view of an analytic model of an antenna device according to an embodiment.

The feeding element 21 and the radiating element 22 are at such a distance from each other that they can be coupled by electromagnetic field coupling. The radiating element 22 is fed by the feeding element 21 in a non-contact manner through electromagnetic field coupling at the feeding part 36. By being fed as described above, the radiating element 22 functions as a radiating conductor of an antenna. As illustrated by FIG. 1A, when the radiating element 22 is a linear conductor connecting two points, a resonance current (distribution) similar to that of a half-wave dipole antenna is formed on the radiating element 22. In other words, the radiating element 22 functions as a dipole antenna that resonates at a half-wavelength of a predetermined frequency (which is hereafter referred to as a dipole mode). Also, a radiating element may be a loop conductor as in an antenna device 8 of FIG. 1B. FIG. 1B exemplifies a loop radiating element 24. When a radiating element is a loop conductor, a resonance current (distribution) similar to that of a loop antenna is formed on the radiating element. In other words, the radiating element 24 functions as a loop antenna that resonates at one wavelength of a predetermined frequency (which is hereafter referred to as a "loop mode").

Electromagnetic field coupling uses a resonance phenomenon of an electromagnetic field, and is disclosed, for example, in a non-patent document (A. Kurs et al, "Wireless Power Transfer via Strongly Coupled Magnetic Resonances," Science Express, Vol. 317, No. 5834, pp. 83-86, July 2007). Electromagnetic field coupling is also called "electromagnetic field resonant coupling" or "electromagnetic field resonance coupling". Electromagnetic field coupling is a technology where resonators that resonate at the same frequency are disposed close to each other, one of the resonators is caused to resonate to generate a near field (non-radiation field area) between the resonators, and energy is transmitted to another one of the resonators via coupling by the near field. Also, electromagnetic field coupling indicates coupling via an electric field and a magnetic field at a high frequency excluding electrostatic capacitive coupling and electromagnetic induction coupling. Here, "excluding electrostatic capacitive coupling and electromagnetic induction coupling" does not indicate completely eliminating electrostatic capacitive coupling and electromagnetic induction coupling, but indicates that their influence is negligible. A medium between the feeding element 21 and the radiating element 22 may be air or a dielectric material such as glass or resin. It is preferable to not place a conductive material such as a ground plane or a display between the feeding element 21 and the radiating element 22.

A configuration that is resistant to an impact is obtained by coupling the feeding element 21 and the radiating element 22 by electromagnetic field coupling. That is, using electromagnetic field coupling makes it possible to feed the radiating element 22 using the feeding element 21 without bringing the feeding element 21 and the radiating element 22 into physical contact with each other, and thereby makes it possible to provide a configuration that is more resistant to an impact than a contact feeding mechanism requiring a physical contact.

Also, compared with a configuration where the radiating element 22 is fed by electrostatic capacitive coupling, the configuration where the radiating element is fed by electromagnetic field coupling makes it possible to reduce the decrease in the total efficiency (antenna gain) of the radiating element 22 at an operating frequency in relation to a change in the distance (coupling distance) between the feeding element 21 and the radiating element 22. Here, total efficiency is a quantity calculated by a formula "antenna radiation efficiency x return loss", and is defined as the efficiency of an antenna relative to input power. Therefore, coupling the feeding element 21 and the radiating element 22 by electromagnetic field coupling makes it possible to more flexibly determine the positions of the feeding element 21 and the radiating element 22, and also makes it possible to improve positional robustness. Here, high positional robustness indicates that displacement of the feeding element 21 and the radiating element 22 has little influence on the total efficiency of the radiating element 22. Also, being able to flexibly determine the positions of the feeding element 21 and the radiating element 22 makes it possible to easily reduce the space necessary to install the antenna device 1. Also, using electromagnetic field coupling makes it possible to feed the radiating element by the feeding element 21 without using an extra component such as a capacitor plate. Accordingly, compared with a case where electrostatic capacitive coupling is used for feeding, using electromagnetic field coupling makes it possible to feed the feeding element 21 with a simple configuration.

In FIG. 1A, the feeding part 36 at which the feeding element 21 feeds the radiating element 22 is located at a portion of the radiating element 22 that is between an end 22*a* and an end 22*b* of the radiating element 22 and other than a center portion 90 (i.e., a portion between the center portion 90 and the end 22*a* or between the center portion 90 and the end 22*b*). Thus, the feeding part 36 is located at a portion of the radiating element 22 other than a lowest impedance portion (in this example, the center portion 90) whose impedance is lowest in the radiating element 22 at a resonance frequency of a fundamental mode of the radiating element 22. This makes it possible to easily achieve impedance matching of the antenna device 1. The feeding part 36 is defined by a conductor portion of the radiating element 22 that is closest to the feeding element 21 and closest to the feed point 14.

In the dipole mode, the impedance of the radiating element 22 gradually increases from the center portion 90 toward the end 22*a* and the end 22*b*. When the feeding element 21 and the radiating element 22 are coupled by electromagnetic field coupling at high impedance greater than a predetermined value, a slight change in the impedance between the feeding element 21 and the radiating element 22 does not greatly affect impedance matching. Therefore, to easily achieve impedance matching, the feeding part 36 of the radiating element 22 is preferably located at a high impedance portion of the radiating element 22.

For example, to easily achieve the impedance matching of the antenna device 1, the feeding part 36 is preferably located at a portion of the radiating element 22 that is away from a lowest impedance portion (in this example, the center portion 90), whose impedance is lowest in the radiating element 22 at a resonance frequency of the fundamental mode of the radiating element 22, by a distance greater than or equal to ⅛ (more preferably ⅙, and further preferably ¼) of the entire length of the radiating element 22. In FIG. 1A, the entire length of the radiating element 22 is indicated by L22, and the feeding part 36 located at a position closer to the end 22*a* than the center portion 90.

On the other hand, when the distance between a capacitor plate and a radiating conductor increases even slightly in a case where impedance matching is achieved in low impedance coupling such as electrostatic capacitive coupling as disclosed in Japanese Laid-Open Patent Publication No. 2001-244715, the capacitance decreases and the impedance between the capacitor plate and the radiating conductor increases. As a result, the impedance matching becomes unachievable.

When Le21 indicates an electrical length that imparts a fundamental mode of resonance to the feeding element 21, Le22 indicates an electrical length that imparts a fundamental mode of resonance to the radiating element 22, and λ indicates a wavelength on the feeding element 21 or the radiating element 22 at a resonance frequency $f_{11}$ of the fundamental mode of the radiating element 22, Le21 is preferably less than or equal to (⅜)·λ, and Le22 is preferably greater than or equal to (⅜)·λ and less than or equal to (⅝)·λ when the fundamental mode of resonance of the radiating element 22 is the dipole mode or greater than or equal to (⅞)·λ and less than or equal to (9/8)·λ when the fundamental mode of resonance of the radiating element 22 is the loop mode.

Le21 is preferably less than or equal to (⅜)·λ. When it is desired to flexibly design the shape of the feeding element 21 including the presence or absence of the ground plane 12, Le21 is more preferably greater than or equal to (1/8)·λ and less than or equal to (3/8)·λ, and further preferably greater than or equal to (3/16)·λ and less than or equal to (5/16)·λ When Le21 is within the above ranges, the feeding element 21 resonates properly at a design frequency (resonance frequency $f_{11}$) of the radiating element 22, the feeding element 21 and the radiating element 22 resonate with each other without depending on the ground plane 12 of the antenna device 1, and appropriate electromagnetic field coupling can be achieved.

When the ground plane 12 is formed such that the edge 12*a* extends along the radiating element 22, a resonance current (distribution) can be formed on the feeding element 21 and the ground plane 12 as a result of an interaction between the feeding element 21 and the edge 12*a*, and the feeding element 21 resonates and is coupled with the radiating element 22 by electromagnetic field coupling. For this reason, there is no specific lower limit for the electrical length Le21 of the feeding element 21 as long as the feeding element 21 has a length that is sufficient to be physically coupled with the radiating element 22 by electromagnetic field coupling. When electromagnetic field coupling is achieved, it indicates that impedance matching is achieved. In this case, it is not necessary to determine the electrical length of the feeding element 21 according to the resonance frequency of the radiating element 22. This in turn makes it possible to freely design the feeding element 21 as a radiating conductor, and thereby makes it possible to easily implement the antenna device 1 supporting multiple frequencies. The sum of the length of the edge 12*a* of the ground plane 12 extending along the radiating element 22 and the electrical length of the feeding element 21 is preferably greater than or equal to (1/4)·λ of the design frequency (resonance frequency $f_{11}$).

When the feeding element 21 does not include a component such as a matching circuit, a physical length L21 of the feeding element 21 is determined by $\lambda_{g1}=\lambda_0 \cdot k_1$, where $\lambda_0$ indicates the wavelength of a radio wave in a vacuum at the resonance frequency of the fundamental mode of the radiating element 22 and $k_1$ indicates a shortening coefficient of a wavelength shortening effect in an actual environment. Here, $k_1$ is calculated based on, for example, a relative permittivity, a relative permeability (e.g., an effective relative permittivity ($\in_{r1}$) and an effective relative permeability ($\mu_{r1}$) of an environment of the feeding element 21), and a thickness of a medium (environment) such as a dielectric substrate where the feeding element 21 is placed, and a resonance frequency. That is, L21 is less than or equal to $(3/8)\cdot\lambda_{g1}$. The shortening coefficient may be calculated based on the physical properties described above, or by actual measurement. For example, a resonance frequency of a target element placed in an environment whose shortening coefficient is to be obtained is measured, a resonance frequency of the same target element is measured in an environment whose shortening coefficient for each frequency is known, and the shortening coefficient may be calculated based on a difference between the measured resonance frequencies.

The physical length L21 of the feeding element 21 is a physical length that gives Le21. In an ideal case where no other factor is considered, the physical length L21 is equal to Le21. When, for example, the feeding element 21 includes a matching circuit, L21 is preferably greater than zero and less than or equal to Le21. By using a matching circuit such as an inductor, L21 can be reduced (i.e., the size of the feeding element 21 can be reduced).

When the fundamental mode of resonance of the radiating element 22 is the dipole mode (i.e., when the radiating element 21 is a linear conductor having open ends), Le22 is preferably greater than or equal to (3/8)·λ and less than or equal to (5/8)·λ, more preferably greater than or equal to (7/16)·λ and less than or equal to (9/16)·λ, and further preferably greater than or equal to (15/32)·λ and less than or equal to (17/32)·λ. When a higher-order mode is taken into account, Le22 is preferably greater than or equal to (3/8)·λ·m and less than or equal to (5/8)·λ·m, more preferably greater than or equal to (7/16)·λ·m and less than or equal to (9/16)·λ·m, and further preferably greater than or equal to (15/32)·λ·m and less than or equal to (17/32)·λ·m. Here, m indicates a mode number of a higher-order mode and is represented by a natural number. The value of m is preferably an integer between 1 through 5, and more preferably an integer between 1 through 3. In this case, m=1 indicates the fundamental mode. When Le22 is within the above ranges, the radiating element 22 functions sufficiently as a radiating conductor, and the efficiency of the antenna device 1 becomes high.

When the fundamental mode of resonance of the radiating element 22 is the loop mode (i.e., when the radiating element 21 is a loop conductor), Le22 is preferably greater than or equal to (7/8)·λ and less than or equal to (9/8)·λ, more preferably greater than or equal to (15/16)·λ and less than or equal to (17/16)·λ, and further preferably greater than or equal to (31/32)·λ and less than or equal to (33/32)·λ. For a higher-order mode, Le22 is preferably greater than or equal to (7/8)·λ·m and less than or equal to (9/8)·λ·m, more preferably greater than or equal to (15/16)·λ·m and less than or equal to (17/16)·λ·m, and further preferably greater than or equal to (31/32)·λ·m and less than or equal to (33/32)·λ·m.

A physical length L22 of the radiating element is determined by $\lambda_{g2}=\lambda_0 \cdot k_2$, where $\lambda_0$ indicates the wavelength of a radio wave in a vacuum at the resonance frequency of the fundamental mode of the radiating element 22 and $k_2$ indicates a shortening coefficient of a wavelength shortening effect in an actual environment. Here, $k_2$ is calculated based on, for example, a relative permittivity, a relative permeability (e.g., an effective relative permittivity ($\varepsilon_{r2}$) and an effective relative permeability ($\mu_2$) of an environment of the radiating element 22), and a thickness of a medium (environment) such as a dielectric substrate where the radiating element 22 is placed, and a resonance frequency. Thus, L22 is greater than or equal to $(3/8)\cdot\lambda_{g2}$ and less than or equal to $(5/8)\cdot\lambda_{g2}$ when the fundamental mode of resonance of the radiating element 22 is the dipole mode, and is greater than or equal to $(7/8)\cdot\lambda_{g2}$ and less than or equal to $(9/8)\cdot\lambda_{g2}$ when the fundamental mode of resonance of the radiating element is the loop mode. The physical length L22 of the radiating element 22 is a physical length that gives Le22. In an ideal case where no other factor is considered, the physical length L22 is equal to Le22. Even when L22 is reduced by using, for example, a matching circuit such as an inductor, L22 is preferably greater than zero and less than or equal to Le22, and more preferably greater than or equal to 0.4×Le22 and less than or equal to 1×Le22. In the case of the loop radiating element 24 of FIG. 1B, L22 corresponds to the inner circumference of the radiating element 24.

For example, when BT resin (registered trademark), CCL-HL870 (M) (MITSUBISHI GAS CHEMICAL COMPANY, INC.) with a relative permittivity of 3.4, tan δ of 0.003, and a substrate thickness of 0.8 mm is used as a dielectric substrate, L21 is 20 mm when the design frequency of the feeding element 21 used as a radiating conductor is 3.5 GHz, and L22 is 34 mm when the design frequency of the radiating element 22 is 2.2 GHz.

Also, when the interaction between the feeding element 21 and the edge 12*a* of the ground plane 12 can be used as illustrated by FIG. 1A and FIG. 1B, the feeding element 21 may be used as a radiating element as described above. The radiating element 22 is a radiating conductor that is fed by the feeding element 21 in a non-contact manner through electromagnetic field coupling at the feeding part 36, and functions as a λ/2 dipole antenna in the example of FIG. 1A. The feeding element 21 is a linear feeding conductor that can feed the radiating element 22, and is also a radiating conductor that can function as a monopole antenna (e.g., λ/4 monopole antenna) when being fed at the feed point 14. This function of the feeding element 21 is described with reference to FIGS. 2 and 3.

Figure 2:
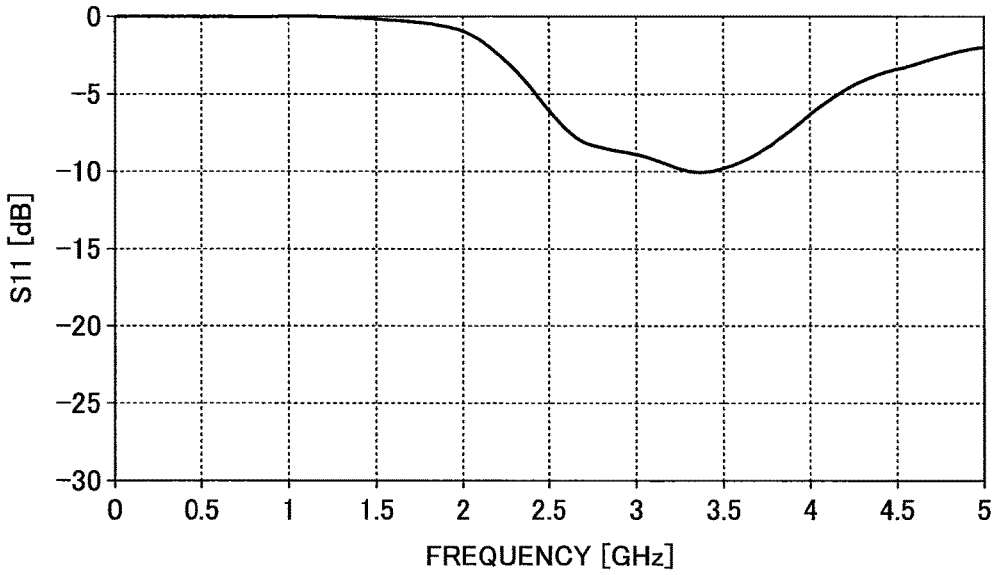
FIG. 2 is a graph illustrating an S11 characteristic of a feeding element according to an embodiment.

FIG. 2 is a graph illustrating an S11 characteristic of the feeding element 21 obtained by a simulation. The S11 characteristic is a type of characteristic of high-frequency electronic components, and is represented by a return loss for each frequency. FIG. 2 illustrates the S11 characteristic obtained in a simulation performed using a configuration where the radiating element 22 is removed from the configuration of the antenna device 1 of FIG. 1A. In the simulation, the feeding element 21 is fed by gap feeding at the feed point 14 between the end 21*a* of the feeding element 21 and the edge 12*a* of the ground plane 12. When the design frequency is set at 3.75 GHz and L21 of the feeding element 21 is set at 20 mm ($=\lambda_0/4$), the feeding element can function as a λ/4 monopole antenna (i.e., a radiating element) using the ground plane 12 as indicated by FIG. 2.

Figure 3:
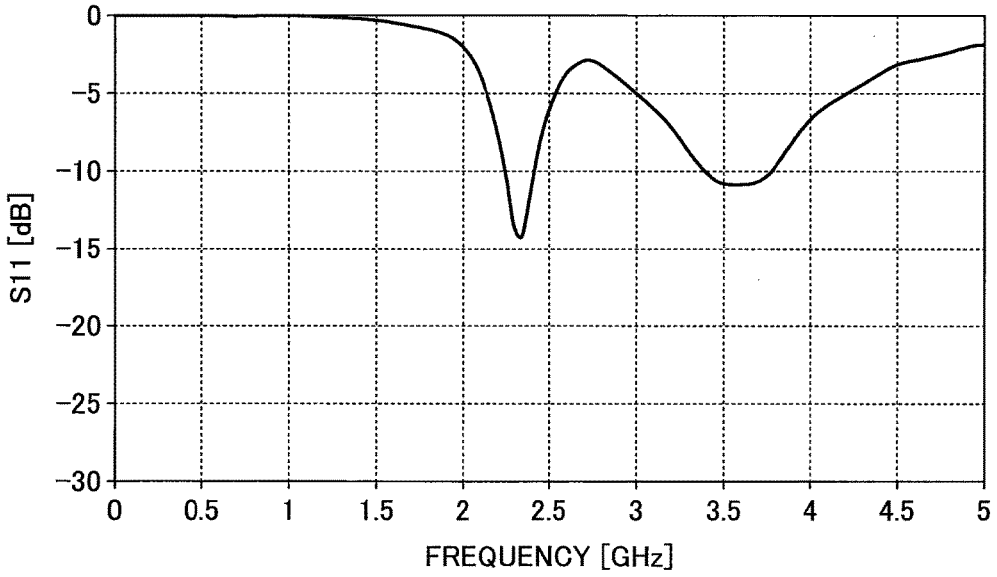
FIG. 3 is a graph illustrating An S11 characteristic of an antenna device according to an embodiment.

FIG. 3 illustrates the S11 characteristic obtained in a simulation performed using a configuration where the radiating element 22 that is parallel to the edge 12*a* of the ground plane 12 is added to the feeding element 21 that functions as a λ/4 monopole antenna as described with reference to FIG. 2. In the simulation, the feeding element 21 is fed by gap feeding at the feed point 14. The radiating element 22 is disposed away from the feeding element 21 in the Z-axis direction by a distance that enables electromagnetic field coupling such that when seen from the Z-axis direction, the end 22*a* of the radiating element 22 overlaps a portion of the feeding element 21 between the end 21*a* and the end 21*b*. When the design frequency is set at 3 GHz and L22 of the radiating element 22 is set at 50 mm ($=\lambda_0/2$), the radiating element 22 can resonate in a frequency band between 2 and 2.5 GHz as indicated by FIG. 3. This indicates that the radiating element 22 can be configured to function as an antenna even when the feeding element 21 is configured to function as a radiating element. Also, when the resonance frequency of the radiating element 22 is $f_1$ and the resonance frequency of the feeding element 21 is $f_2$, it is possible to use the radiation function of the radiating element 22 at the resonance frequency $f_2$.

When the radiation function of the feeding element 21 is used and the feeding element 21 does not include a component such as a matching circuit, the physical length L21 of the feeding element 21 is determined by $\lambda_{g3}=\lambda_1 \cdot k_1$, where $\lambda_1$ indicates the wavelength of a radio wave in a vacuum at the resonance frequency $f_2$ of the feeding element 21 and $k_1$ indicates a shortening coefficient of a wavelength shortening effect in an actual environment. Here, $k_1$ is calculated based on, for example, a relative permittivity, a relative permeability (e.g., an effective relative permittivity ($\varepsilon_{r1}$) and an effective relative permeability ($\mu_{r1}$) of an environment of the feeding element 21), and a thickness of a medium (environment) such as a dielectric substrate where the feeding element 21 is placed, and a resonance frequency. That is, L21 is greater than or equal to $(1/8)\cdot\lambda_{g3}$ and less than or equal to $(3/8)\cdot\lambda_{g3}$, and is preferably greater than or equal to $(3/16)\cdot\lambda_{g3}$ and less than or equal to $(5/16)\cdot\lambda_{g3}$. The physical length L21 of the feeding element 21 is a physical length that gives Le21. In an ideal case where no other factor is considered, the physical length L21 is equal to Le21. When, for example, the feeding element 21 includes a matching circuit, L21 is preferably greater than zero and less than or equal to Le21. By using a matching circuit such as an inductor, L21 can be reduced (i.e., the size of the feeding element 21 can be reduced).

In the simulations performed to obtain the results of FIGS. 2 and 3, the ground plane 12 of FIG. 1A is assumed to be a virtual conductor having a horizontal length L1 of 100 mm, a vertical length L2 of 150 mm, and no thickness. Also, the gap between the edge 12*a* of the ground plane 12 and the end 21*a* of the feeding element is set at 1 mm. Further, it is assumed that no dielectric substrate exists.

When $\lambda_0$ indicates the wavelength of a radio wave in a vacuum at the resonance frequency of the fundamental mode of the radiating element 22, a shortest distance x (>0) between the feeding element 21 and the radiating element 22 is preferably less than or equal to $0.2\times\lambda_0$ (more preferably less than or equal to $0.1\times\lambda_0$, and further preferably less than or equal to $0.05\times\lambda_0$). Arranging the feeding element 21 and the radiating element 22 at the shortest distance x described above makes it possible to improve the total efficiency of the radiating element 22.

Here, the shortest distance x indicates a linear distance between the closest parts of the feeding element 21 and the radiating element 22.

Figure 4:
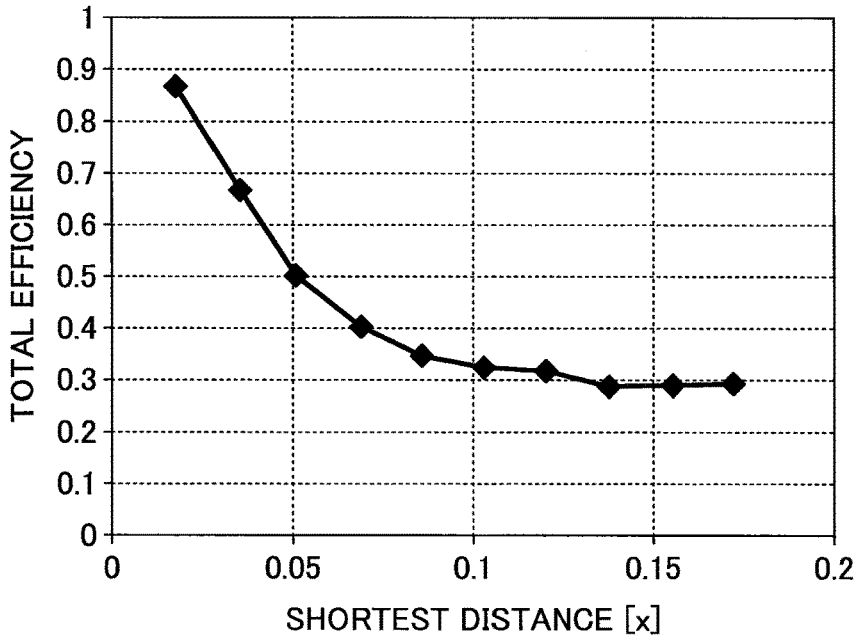
FIG. 4 is a graph illustrating a relationship between a shortest distance D1 between a feeding element and a radiating element and total efficiency of the radiating element.
Figure 5A:
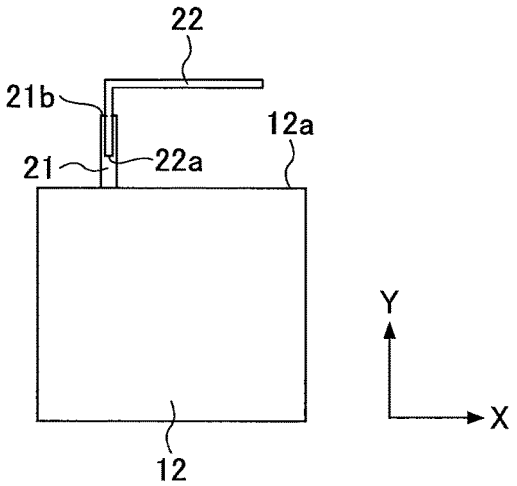
FIG. 5A is a drawing illustrating an antenna device where a crossing angle between a feeding element and a radiating element is +90°.
Figure 5B:
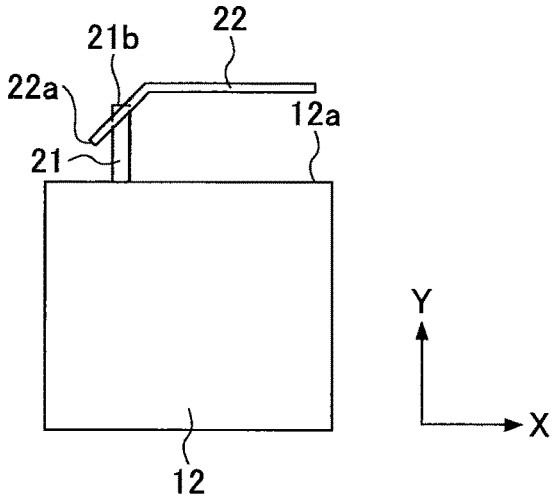
FIG. 5B is a drawing illustrating an antenna device where a crossing angle between a feeding element and a radiating element is +45°.
Figure 5C:
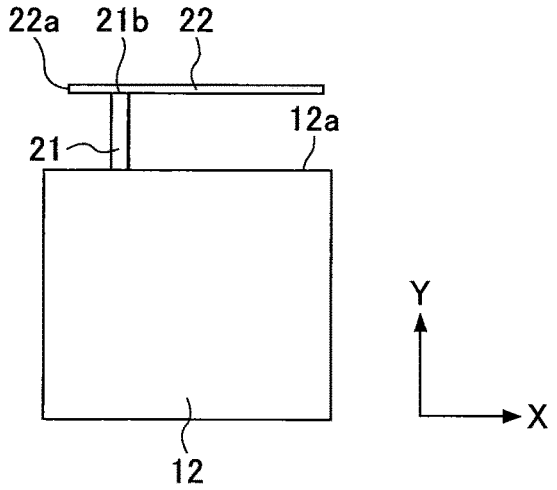
FIG. 5C is a drawing illustrating an antenna device where a crossing angle between a feeding element and a radiating element is 0°.
Figure 5D:
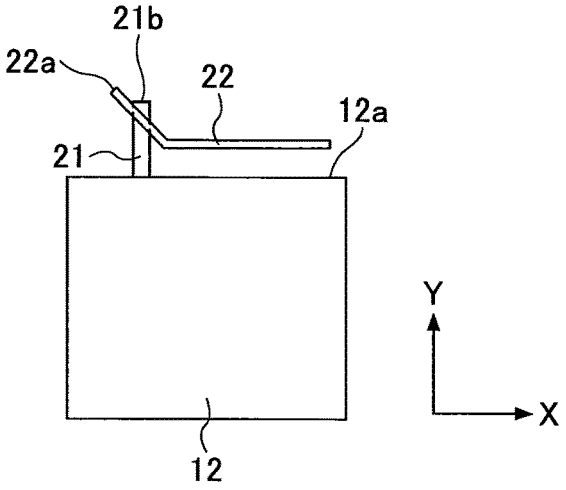
FIG. 5D is a drawing illustrating an antenna device where a crossing angle between a feeding element and a radiating element is −45°.
Figure 5E:
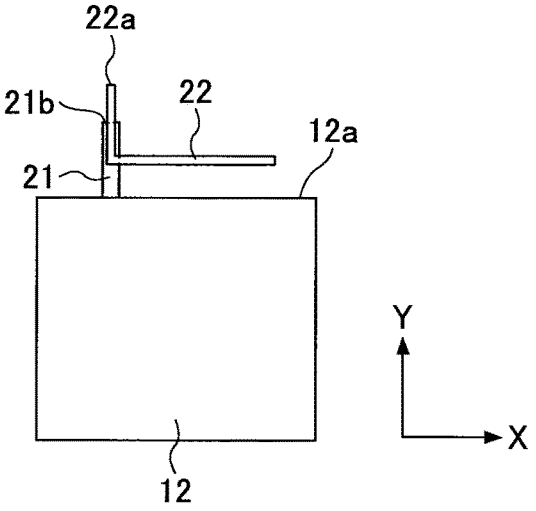
FIG. 5E is a drawing illustrating an antenna device where a crossing angle between a feeding element and a radiating element is −90°.

FIG. 4 is a graph illustrating a relationship between the shortest distance x and the total efficiency of the radiating element 22. Here, the total efficiency indicates a radiation efficiency obtained taking into account the return loss of an antenna, and is calculated by a formula $\eta\times(1-|\Gamma|^2)$ where η indicates a radiation efficiency and Γ indicates a return loss. In a simulation performed to obtain the results of FIG. 4, the ground plane 12 of FIG. 1A is assumed to be a virtual conductor having a horizontal length L1 of 100 mm, a vertical length L2 of 150 mm, and no thickness. Also, the gap between the edge 12*a* of the ground plane 12 and the end 21*a* of the feeding element 21 is set at 1 mm. Also in the simulation, it is assumed that gap feeding is performed at the feed point 14, and a matching circuit 15 having an inductance of 20 nH is inserted in series between the feed point 14 and the end 21*a* of the feeding element 21. Further, L21 of the feeding element 21 is set at 5 mm, and L22 of the radiating element 22 is set at 50 mm. Thus, properly adjusting the matching circuit 15 connected to the feeding element 21 makes it possible to achieve electromagnetic field coupling even when L21 of the feeding element 21 is reduced, and thereby makes it possible to reduce the mounting area of the feeding element 21 and to reduce an area occupied by a circuit board.

Although the matching circuit 15, which is an inductor, is used in this example, a capacitor may be used instead of an inductor. Also, although an inductor is inserted in series in this example, the circuit configuration is not limited to this example, and any known matching technology may be used. Further, even when the length of the feeding element 21 is constant, it is possible to adaptively change operating frequencies and frequency bands by electronically changing the constant of the matching circuit 15. This in turn makes it possible to implement a tunable antenna.

The radiating element 22 is disposed away from the feeding element 21 in the Z-axis direction such that when seen from the Z-axis direction, the end 22*a* of the radiating element 22 overlaps a portion of the feeding element 21 between the end 21*a* and the end 21*b*. In this case, the shortest distance x corresponds to the linear distance between the end 22*a* of the radiating element 22 facing the feeding element 21 and the end 21*b* of the feeding element 21 facing the radiating element 22.

The results of FIG. 4 are obtained by calculating the total efficiency of the radiating element 22 while changing the shortest distance x by moving the radiating element 22 horizontally away from the feeding element 21 in the Z-axis direction with the position of the feeding element 21 fixed. The vertical axis of FIG. 4 indicates the total efficiency of the radiating element 22 when the frequency of a radio wave is set at 2.6 GHz. The horizontal axis of FIG. 4 indicates the shortest distance x that is normalized to one wavelength (i.e., the distance per one wavelength).

As illustrated by FIG. 4, the total efficiency of the radiating element 22 decreases as the distance between the radiating element 22 and the feeding element 21 increases because the coupling strength of electromagnetic field coupling between the radiating element 22 and the feeding element 21 decreases. Accordingly, the shortest distance x is preferably less than or equal to $0.2\times\lambda_0$ (more preferably less than or equal to $0.1\times\lambda_0$, and further preferably less than or equal to $0.05\times\lambda_0$) in order to improve the total efficiency of the radiating element 22.

Also, a distance for which the feeding element and the radiating element 22 run parallel to each other at the shortest distance x is preferably less than or equal to ⅜, more preferably less than or equal to ¼, and further preferably less than or equal to ⅛ of the physical length of the radiating element 22. Because the coupling strength between portions of the feeding element 21 and the radiating element 22 at the shortest distance x is high, when the distance for which the feeding element 21 and the radiating element 22 run parallel to each other at the shortest distance x is long, the feeding element 21 is coupled strongly with both of a high-impedance portion and a low-impedance portion of the radiating element 22. As a result, the impedance matching may become unachievable. Therefore, the distance for which the feeding element 21 and the radiating element 22 run parallel to each other at the shortest distance x is preferably short so that the feeding element 21 is strongly coupled with only a portion of the radiating element 22 having relatively constant impedance, and the impedance matching is achieved.

FIGS. 5A through 5E illustrate five variations of the antenna device 1 where the feeding element 21 and the radiating element 22 intersect at different crossing angles. In FIGS. 5A through 5E, a 10-mm end portion of the radiating element 22 from the end 22*a* is rotated about the end 21*b* of the feeding element 21. As long as the feeding element 21 and the radiating element 22 are coupled by electromagnetic field coupling, desired total efficiency of the radiating element 22 can be achieved regardless of the crossing angle at which the feeding element 21 and the radiating element 22 intersect. Also, the characteristic of the total efficiency of the radiating element 22 is little affected by a change in the crossing angle.

Figure 6:
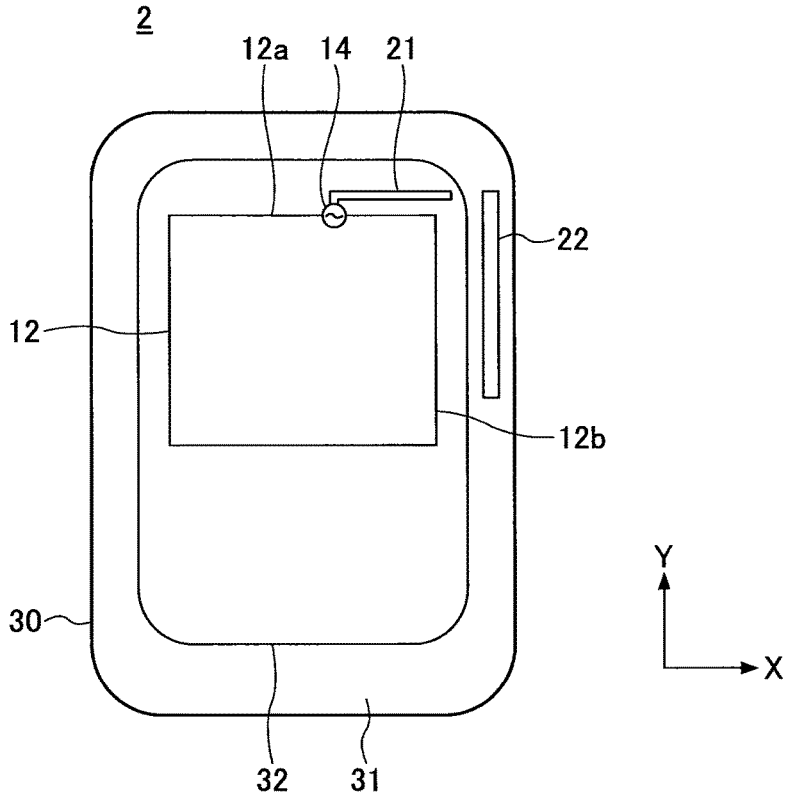
FIG. 6 is a see-through plan view of a wireless apparatus where an antenna device is installed.

FIG. 6 is a plan view of a wireless communication apparatus 2 where the antenna device 1 is installed. In FIG. 6, the wireless communication apparatus 2 is made transparent so that the layout of the components of the antenna device 1 including the feeding element 21, the radiating element 22, and the ground plane 12 can be seen. The ground plane 12 in FIG. 6 is a ground plane of a circuit board (not shown). This ground plane 12 is electrically connected to a ground plane of a system (not shown), and therefore the ground plane 12 of the antenna device 1 indicates the ground plane of the system.

The wireless communication apparatus 2 is a portable wireless apparatus. Examples of the wireless communication apparatus 2 include electronic apparatuses such as an information terminal, a cellphone, a smartphone, a personal computer, a game machine, a television, and music and video players.

The wireless communication apparatus 2 includes a housing 30, a display 32 disposed in the housing 30, and a cover glass 31 that entirely covers an image display surface of the display 32. Here, the housing 30 is a component that forms a part or the whole of the outer shape of the wireless communication apparatus 2, and is a container that houses and protects, for example, a circuit board including the ground plane 12. The housing 30 may be composed of multiple components including a back cover 33.

The display 32 may include a touch sensor function. The cover glass 31 is a dielectric substrate that is transparent or translucent to allow a user to see an image displayed on the display 32, and is a tabular component stacked on the display 32. The cover glass 31 has a size that is the same as or slightly smaller than the size of the outer shape of the housing 30.

An outer surface of the cover glass 31 that is opposite to a surface of the cover glass 31 facing the display 32 is defined as a first surface, and the surface facing the display 32 is defined as a second surface.

When the radiating element 22 is formed on the second surface of the cover glass 31, the feeding element 21 exemplified in FIG. 6 includes a conductor portion that is parallel to the edge 12*a* of the ground plane 12, and is disposed inside of the outer edge of the display 32 when the display 32 is seen from the Z-axis direction. However, the feeding element 21 may instead be disposed outside of the outer edge of the display 32 when the display 32 is seen from the Z-axis direction, or may be disposed to extend across the outer edge of the display 32 from the inside to the outside.

The radiating element 22 exemplified in FIG. 6 includes a conductor portion that is parallel to an edge 12*b* of the ground plane 12, and is disposed outside of the outer edge of the display 32 when the display 32 is seen from the Z-axis direction. This configuration makes it possible to place the radiating element 22 away from the circuit board (not shown) where the ground plane 12 is formed or from the display 32, and is therefore preferable in order to prevent noise interference. However, the radiating element 22 may instead be disposed inside of the outer edge of the display 32 when the display 32 is seen from the Z-axis direction, or may include a conductor portion that extends across the outer edge of the display 32 from the inside to the outside.

When a metal is used for a part of the housing 30 forming a part or the whole of the outer shape of the wireless communication apparatus 2, the radiating element 22 may be implemented by the metal constituting the part of the housing 30. In, for example, recent smartphones, only a small space is available for installing an antenna. Therefore, using a metal constituting a part of a housing as a radiating element makes it possible effectively use a space.

As a wireless apparatus according to a preferred embodiment of the present invention, as illustrated by FIG. 6, the wireless communication apparatus 2 may include the housing 30, the display 32 disposed in the housing 30, and the cover glass 31 that entirely covers the image display surface of the display 32. Also, the feeding element 21 of the antenna device 1 of an embodiment of the present invention may be disposed in the housing 30, and the radiating element 22 of the antenna device 1 may be disposed on a surface of the cover glass 31 (preferably the second surface of the cover glass 31).

Figure 7:
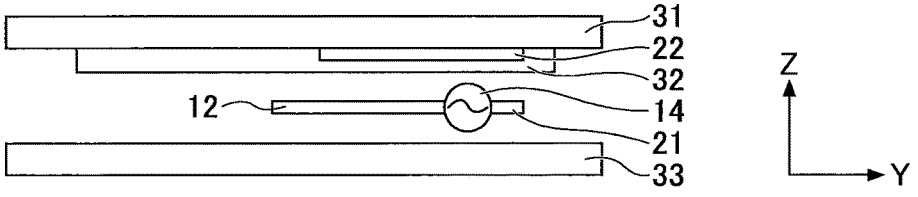
FIG. 7 is a side view of a wireless apparatus where an antenna device is installed.
Figure 8A:
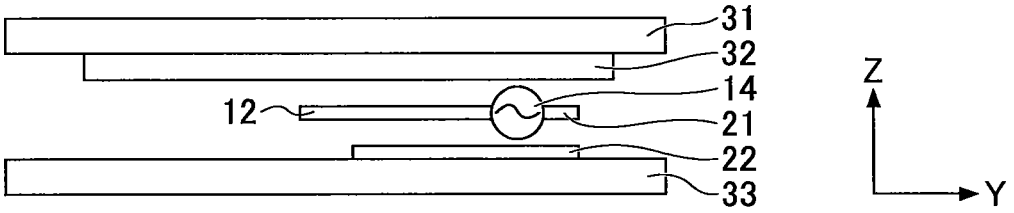
FIG. 8A is a side view of a wireless apparatus where an antenna device is installed.
Figure 8B:
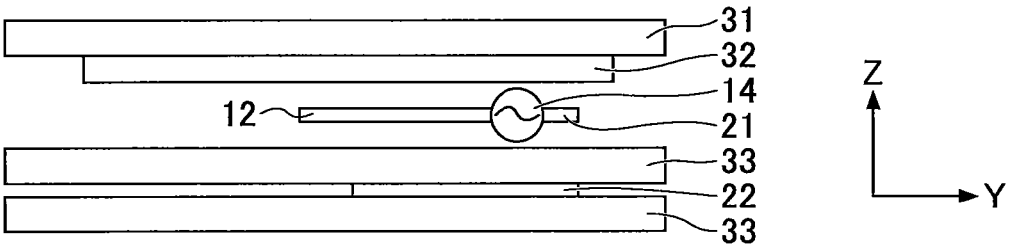
FIG. 8B is a side view of a wireless apparatus where an antenna device is installed.

FIGS. 7, 8A, and 8B exemplify positional relationships among components of the antenna device 1 and the wireless communication apparatus 2 in a height direction that is parallel to the Z axis.

FIG. 7 is a side view of the wireless communication apparatus 2 where the radiating element 22 of the antenna device 1 is disposed on the cover glass 31. In the example of FIG. 7, the radiating element 22 is formed flatly on the periphery of the second surface of the cover glass 31 facing the display 32. However, the radiating element 22 may be formed on the first surface of the cover glass 31 that is opposite to the second surface facing the display 32, or on an edge face of the cover glass 31. As illustrated by FIGS. 6 and 7, the radiating element 22 is preferably disposed such that a portion of the radiating element 22 extends along an edge of the ground plane 12. This configuration makes it possible, for example, to control the antenna directivity.

When the radiating element 22 is formed on a surface of the cover glass 31, the radiating element 22 may be formed by applying a conductive paste of, for example, copper or silver onto the surface of the cover glass 31 and firing the applied conductive paste. As the conductive paste, a low-temperature-firing conductive paste that can be fired at a temperature that does not reduce the strength of a chemically-strengthened glass forming the cover glass 31 may be used. Also, to prevent the degradation of a conductor due to oxidation, the conductive paste may be, for example, plated. Also, the radiating element 22 may be formed by attaching a copper or silver foil via an adhesive layer to a surface of the cover glass 31. A decorative print may be formed on a part of the cover glass 31, and a conductor may be formed on the part of the cover glass 31. When a black masking film is formed on the periphery of the cover glass 31 to hide, for example, wiring, the radiating element 22 may be formed on the black masking film.

FIGS. 8A and 8B illustrate examples where the radiating element 22 of the antenna device 1 is formed on the back cover 33 of the wireless communication apparatus 2. An inner surface of the back cover 33 that faces the display 32 is defined as a first surface, and a surface opposite to the first surface is defined as a second surface. In the examples of FIGS. 8A and 8B, the radiating element 22 is formed flatly on the periphery of the first surface of the back cover 33 of the wireless communication apparatus 2 to face the display 32. However, the radiating element 22 may be formed on the second surface of the back cover 33 that is opposite to the first surface facing the display 32, on an edge face of the back cover 33, or inside of the back cover 33. The back cover 33 may be a part of the housing 30 illustrated in FIG. 6, or may be provided as a separate component. Also, the back cover 33 may be made of a dielectric material such as resin or a metal material. When the back cover 33 is made of a conductive material, the radiating element 22 is preferably insulated from the back cover 33. The radiating element 22 is not necessarily disposed in the periphery of the back cover 33, and may be disposed in any other appropriate position.

Although a resin such as ABS resin is generally used as a material of the housing 30 and the back cover 33, other materials such as transparent glass, colored glass, and opalescent glass may also be used for the housing 30 and the back cover 33.

Colored glass may be produced by adding, for example, Co, Mn, Fe, Ni, Cu, Cr, V, Zn, Bi, Er, Tm, Nd, Sm, Sn, Ce, Pr, Eu, Ag, or Au as a colorant to components of glass. Examples of opalescent glass include crystallized glass and phase-separated glass that use scattering of light. As crystalized glass, lithium disilicate ($Li_2Si_2O_5$) crystal, nepheline ($(NaK)AlSiO_4$) crystal, and sodium fluoride (NaF) are particularly preferable.

Also, a glass-ceramic substrate obtained by sintering a mixture of glass powder, ceramic powder, and pigment powder may be used as a material for the housing 30 and the back cover 33.

Glass powder having any composition may be used as long as it can be sintered together with ceramic powder at an appropriate temperature. When silver wiring is formed by sintering at a temperature between 800° C. and 900° C., glass composition with a softening point between 700° C. and 900° C., is preferable. Also, to improve the strength as a housing, glass composition including $SiO_2$ such as $SiO_2$—$B_2O_3$—$Al_2O_3$—RO—$R_2O$ is preferable. Here, RO indicates alkaline earth metal oxide, and $R_2O$ indicates alkali metal oxide. $Al_2O_3$ is not essential.

Characteristics such as color and strength of glass ceramic can be flexibly adjusted by changing a combination of glass powder and ceramic powder.

Glass powder may be colored by adding, as a colorant, an element such as Co, Mn, Fe, Ni, Cu, Cr, V, Zn, Bi, Er, Tm, Nd, Sm, Sn, Ce, Pr, Eu, Ag, or Au that causes absorption when added to glass component. Also, the color of glass ceramic may be more flexibly adjusted by mixing pigment powder with glass powder and ceramic powder and sintering the mixture. A typical example of an inorganic pigment is a composite oxide pigment composed of elements selected from, for example, Fe, Cr, Co, Cu, Mn, Ni, Ti, Sb, Zr, Al, Si, and P. To improve the strength, glass powder with glass composition and a particle size that are suitable to be co-sintered with ceramic powder may be selected. As ceramic powder, for example, $Al_2O_3$ or $ZrO_2$ with a high strength may be used. The shape of ceramic powder also greatly influences the strength. The permittivity may be adjusted by selecting ceramic powder with a desired permittivity. The thermal expansion coefficient may be adjusted by selecting a combination of glass powder (glass composition) and ceramic powder having desired thermal expansion coefficients. Also, sintering shrinkage of glass ceramic may also be adjusted by selecting the shape of ceramic powder. A conductor pattern may be formed by screen-printing a pattern with a commercial silver paste for sintering at a temperature between 800° C. and 900° C., and drying the printed pattern. Alternatively, a conductor pattern may be formed by pasting a copper or silver foil.

When the glass ceramic substrate is used for the back cover 33, the back cover 33 may be formed as a multilayer structure. In this case, a conductor pattern may be formed on an inner layer of the multilayer structure, and a part of the conductor pattern may be used as a radiating element. For example, as illustrated by FIG. 8B, the radiating element 22 may be formed on an inner layer of the back cover 33 formed with a two-layer glass ceramic substrate. With this configuration, the radiating element 22 is not exposed to the outside. Therefore, this configuration makes it possible to prevent degradation and peeling of a conductor resistor, and to improve reliability. The multilayer structure of the back cover 33 may include more than two layers, and the radiating element 22 may be formed on the outermost layer of the multilayer structure, and on any inner layer of the multilayer structure.

When the radiating element 22 is formed on the cover glass 31, the radiating element 22 is preferably formed as a linear conductor. On the other hand, when the radiating element 22 is formed on the housing 30 or the back cover 33, the radiating element 22 may be disposed in any position and may be formed as any one of a linear conductor, a loop conductor, and a patch conductor. The patch conductor may have any planar shape such as a substantially-square shape, a substantially-rectangular shape, a substantially-circular shape, or a substantially-oval shape.

Also, as exemplified by FIGS. 7, 8A, and 8B, the feeding element 21, the radiating element 22, and the ground plane 12 may be disposed in different positions in a height direction that is parallel to the Z axis. Also, some of or all of the positions of the feeding element 21, the radiating element 22, and the ground plane 12 in the height direction may be the same.

As a wireless apparatus according to a preferred embodiment of the present invention, as illustrated by FIGS. 8A and 8B, the wireless communication apparatus 2 may include the housing 30 (including the back cover 33) and the display 32 disposed in the housing 30. Also, the feeding element 21 of the antenna device 1 of an embodiment of the present invention may be disposed in the housing 30, and the radiating element 22 of the antenna device 1 may be disposed on a surface of the back cover 33 or inside of the back cover 33.

Figure 9A:
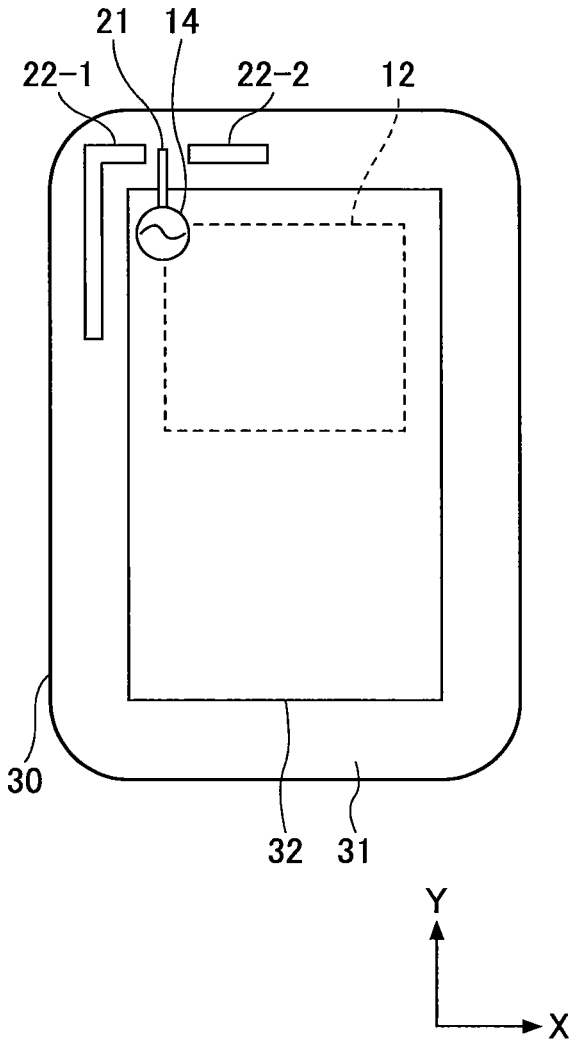
FIG. 9A is a see-through plan view of a wireless apparatus where multiple radiating elements are fed by one feeding element.
Figure 9B:
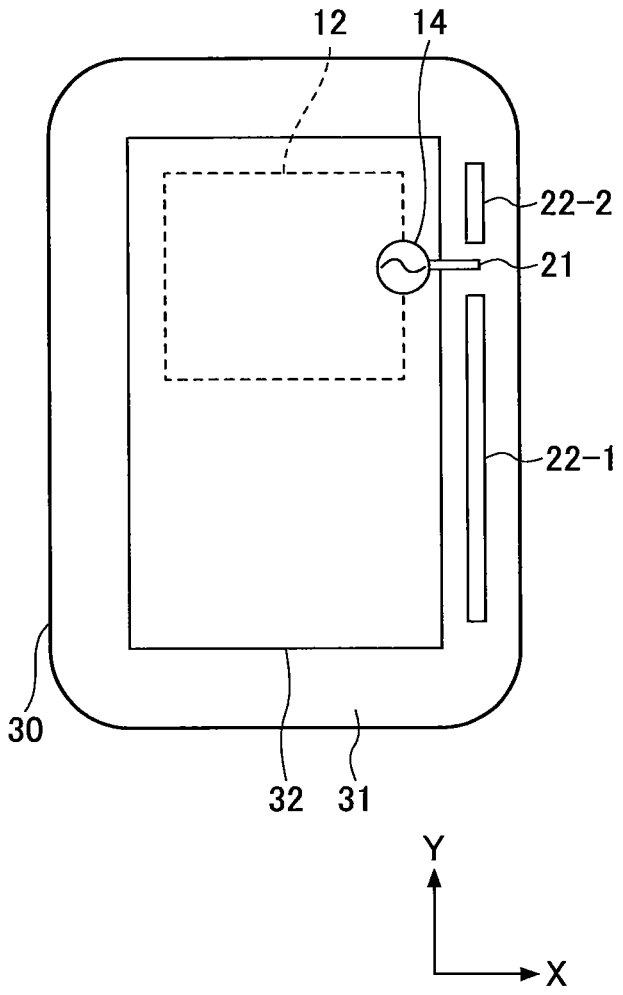
FIG. 9B is a see-through plan view of a wireless apparatus where multiple radiating elements are fed by one feeding element.

FIGS. 9A and 9B are see-through plan views of the wireless communication apparatus 2 including the antenna device 1 where multiple radiation elements are fed by one feeding element 21. In the examples of FIGS. 9A and 9B, two radiation elements are fed by one feeding element 21. However, three or more radiation elements may be fed by one feeding element 21. Using multiple radiating elements makes it possible to provide a multiband or wideband antenna device, and to control the directivity of an antenna device.

In the example of FIG. 9A, two radiating elements 22-1 and 22-2 are disposed along two adjacent edges of the display 32 that are orthogonal to each other, and the radiating elements 22-1 and 22-2 are fed by one feeding element 21. The radiating element 22-1 includes a portion that extends along the left edge of the display 32, and the radiating element 22-2 includes a portion that extends along the upper edge of the display 32.

In the example of FIG. 9B, both of two radiating elements 22-1 and 22-2 are disposed along an edge of the display 32, and the radiating elements 22-1 and 22-2 are fed by one feeding element 21. Each of the radiating elements 22-1 and 22-2 includes a portion that extends along the right edge of the display 32.

Figure 10A:
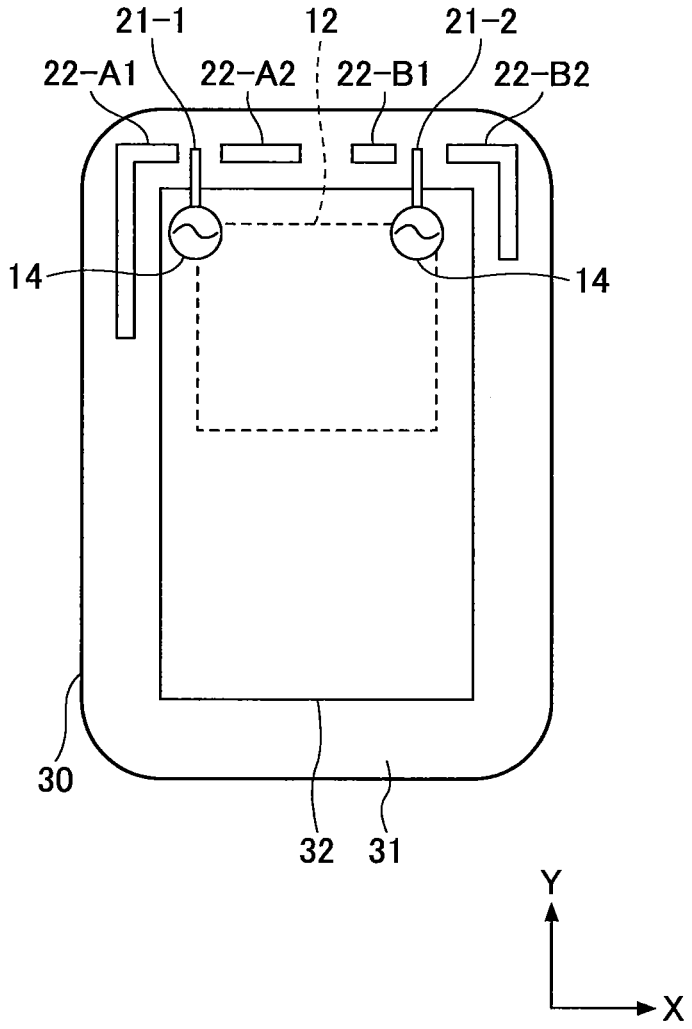
FIG. 10A is a see-through plan view of a wireless apparatus where multiple antenna devices are installed.
Figure 10B:
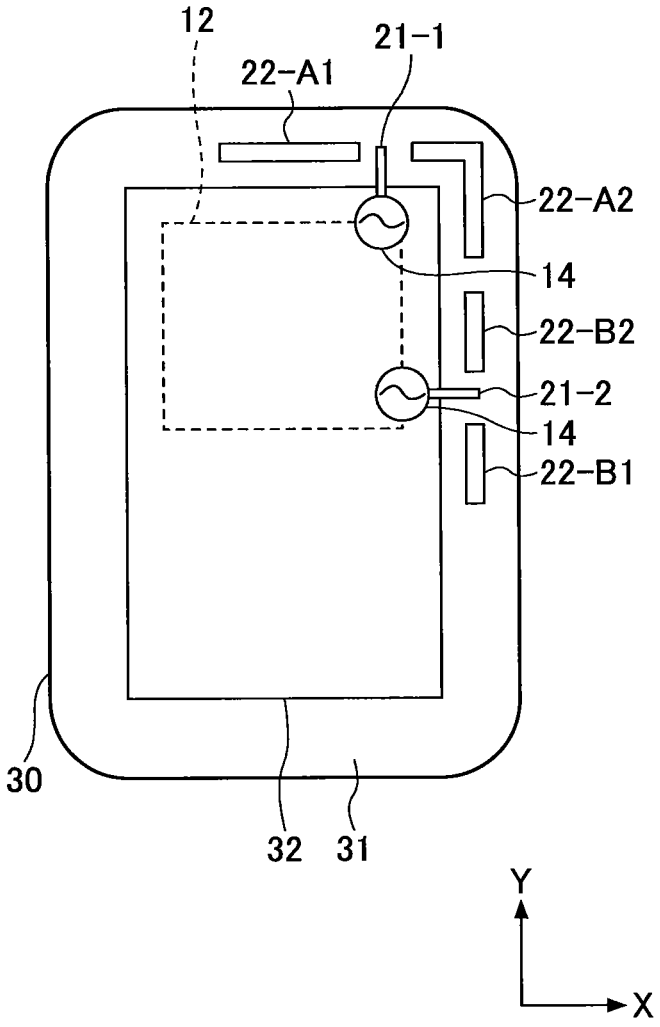
FIG. 10B is a see-through plan view of a wireless apparatus where multiple antenna devices are installed.
Figure 10C:
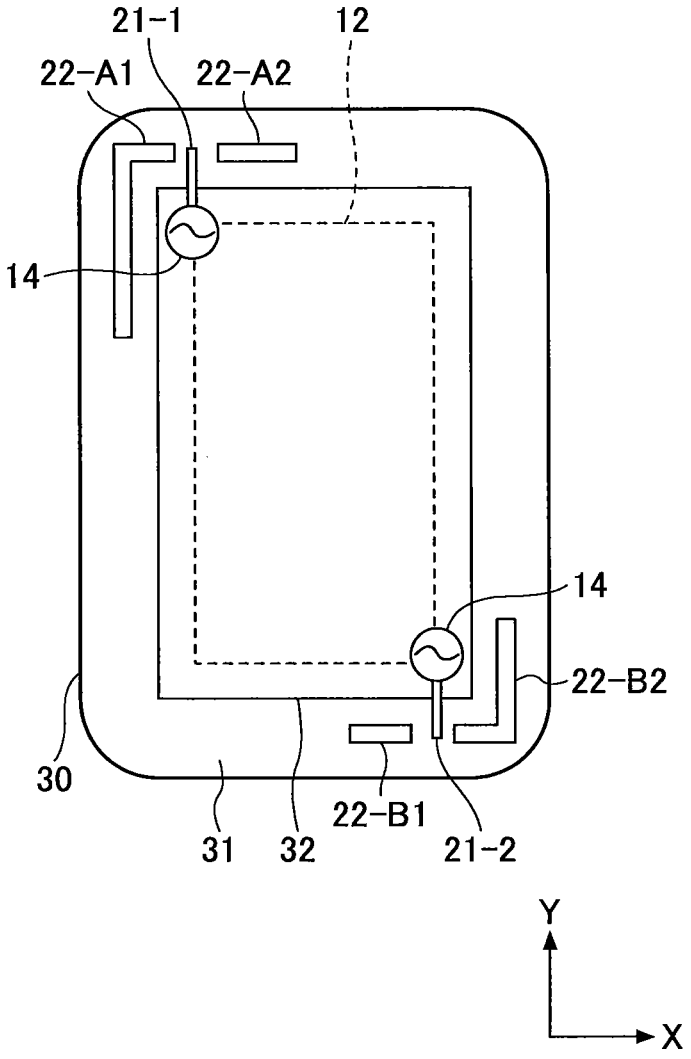
FIG. 10C is a see-through plan view of a wireless apparatus where multiple antenna devices are installed.

FIGS. 10A, 10B, and 10C are see-through plan views of the wireless communication apparatus 2 including multiple antenna devices 1. In the examples of FIGS. 10A, 10B, and 10C, two radiating elements 22-A1 and 22-A2 are fed by a feeding element 21-1, and two radiating elements 22-B1 and 22-B2 are fed by a feeding element 21-2.

Also in the examples of FIGS. 10A, 10B, and 10C, one of radiating elements of each antenna device is disposed orthogonal to another one of the radiating elements. Here, "another one of the radiating elements" may indicate "all other radiating elements", "another radiating element", and "other radiating elements". Arranging the radiating elements 22 orthogonal to each other makes it possible to suppress the interference between the radiating elements 22.

In the example of FIG. 10A, the radiating element 22-A1 and the radiating element 22-B1 include conductor portions that are orthogonal to each other, and the radiating element 22-A2 and the radiating element 22-B2 include conductor portions that are orthogonal to each other. In the example of FIG. 10B, the radiating element 22-A1 includes a conductor portion that is orthogonal to the radiating elements 22-B2 and 22-B1. In the example of FIG. 10C, the radiating element 22-A1 and the radiating element 22-B1 include conductor portions that are orthogonal to each other, and the radiating element 22-A2 and the radiating element 22-B2 include conductor portions that are orthogonal to each other.

When a wireless apparatus of the present invention includes multiple antennas, the antennas may include both of an antenna employing a non-contact feeding mechanism based on electromagnetic field coupling and an antenna employing another feeding mechanism. Examples of other feeding mechanisms include a contact mechanism using a cable, a flexible substrate, a pin with a spring, and any other elastic part.

Figure 11:
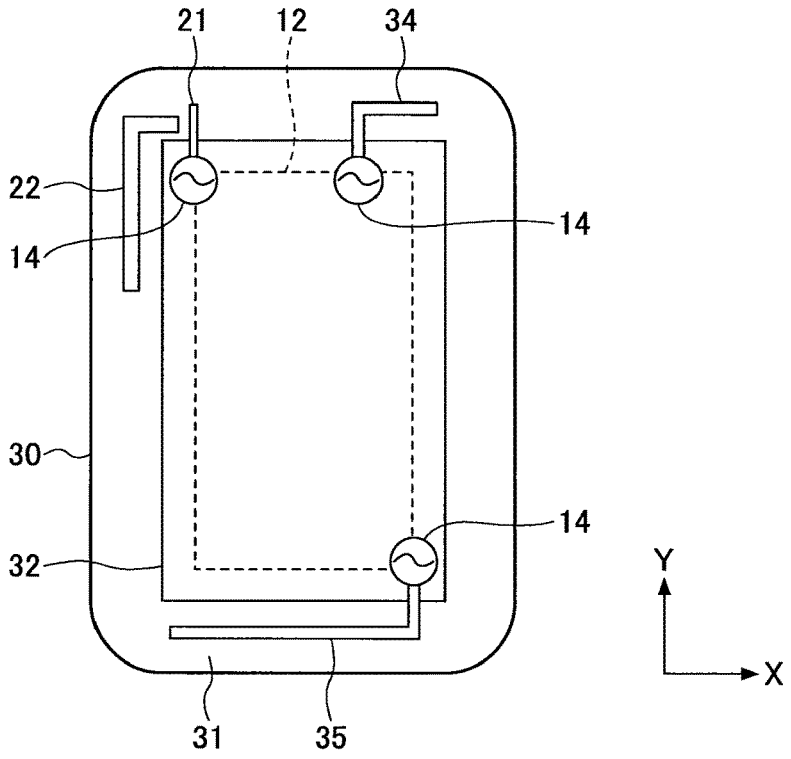
FIG. 11 is a see-through plan view of a wireless apparatus where antenna elements are disposed orthogonal to a radiating element of an antenna device.

FIG. 11 is a see-through plan view of the wireless communication apparatus 2 where other antenna elements 34 and 35 are disposed orthogonal to the radiating element 22 that is fed by the feeding element 21. The radiating element 22 includes a conductor portion that is orthogonal to the antenna elements 34 and 35 that are fed by a feeding mechanism different from the feeding mechanism used for the radiating element 22. Arranging the radiating element 22 orthogonal to the antenna elements 34 and 35 makes it possible to suppress the interference between the radiating element 22 and the antenna elements 34 and 35.

Figure 12:
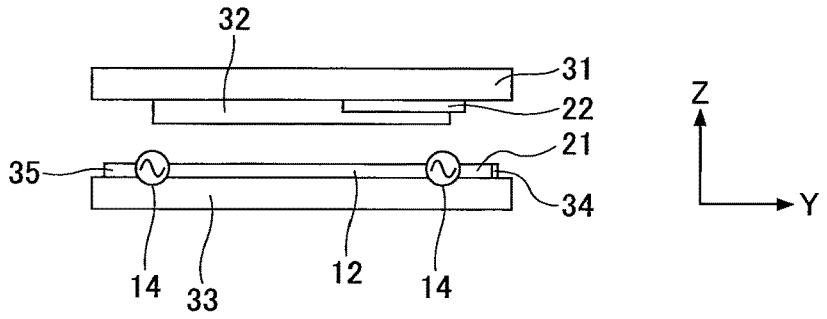
FIG. 12 is a side view illustrating the positional relationship in a height direction between a radiating element and other antenna elements.

FIG. 12 is a side view illustrating the positional relationship in the height direction between the radiation element and the antenna elements 34 and 35. In the example of FIG. 12, the radiating element 22 is formed on a surface of the cover glass 31 facing the display 32, and the antenna elements 34 and 35 and the feeding element 21 are formed on a surface of the back cover 33 facing the display 32. This configuration makes it possible to drastically increase an area available for installing antennas and improve the flexibility in the layout of antennas. Accordingly, this configuration makes it possible to suppress the interference between antennas, and is suitable for a MIMO (Multi Input Multi Output) antenna configuration.

Figure 13:
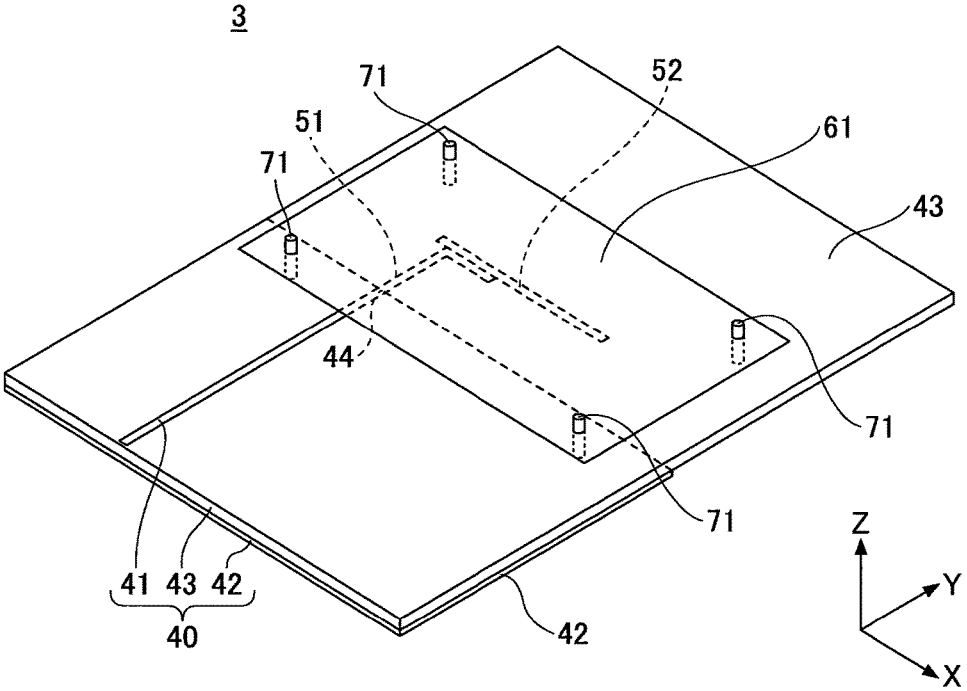
FIG. 13 is a perspective view of an antenna device that has been actually produced.
Figure 14:
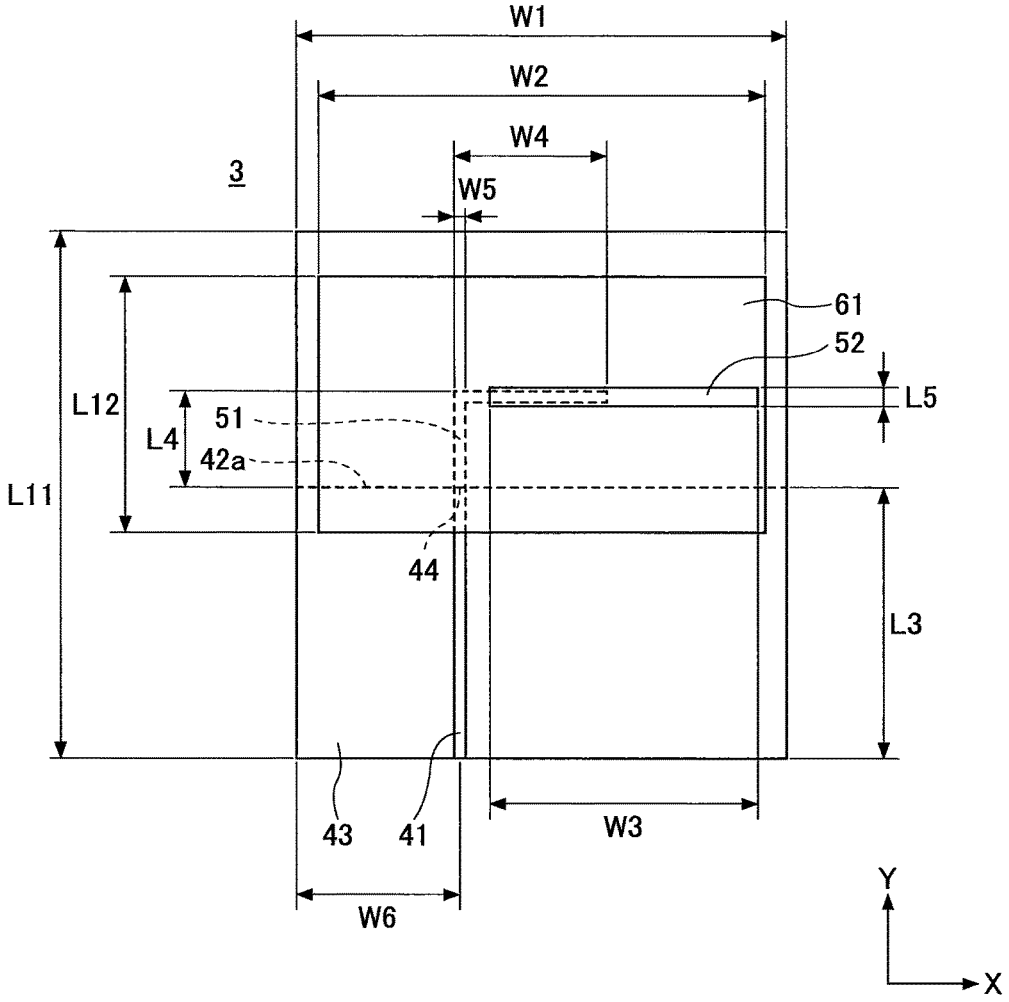
FIG. 14 is a see-through plan view illustrating a configuration of the antenna device of FIG. 13.

FIG. 13 is a perspective view of an antenna device 3 that has been actually produced. FIG. 14 is a see-through plan view illustrating a configuration of the antenna device 3.

The antenna device 3 includes a feeding element 51 connected to a feed point 44, a radiating element 52 that is disposed at a distance from the feeding element 51 and coupled with the feeding element 51 by electromagnetic field coupling, and a microstrip line 40 connected to the feed point 44. The feeding element 51 is connected at the feed point 44 to a strip conductor 41 of the microstrip line 40, and therefore the microstrip line 40 practically functions as a feeding line. The radiating element 52 is formed on one of the surfaces of a cover substrate 61 that is closer to a resin substrate 43 on which the feeding element 51 is formed.

The microstrip line 40 includes the resin substrate 43. A ground plane 42 is formed on one surface of the resin substrate 43, and the linear strip conductor 41 is formed on the opposite surface of the resin substrate 43. The feed point 44 is a connection point between the strip conductor 41 and the feeding element 51. It is assumed that an integrated circuit such as an IC chip connected via the microstrip line 40 to the feed point 44 is mounted on the resin substrate 43.

The feeding element 51 and the strip conductor are disposed on the same surface of the resin substrate 43. As illustrated in FIG. 14, the boundary between the feeding element 51 and the strip conductor 41 is the feed point 44 and coincides with an edge 42*a* of the ground plane 42 in plan view from the Z-axis direction.

Also, as illustrated by FIG. 13, the antenna device 3 includes the cover substrate 61 that is disposed above the resin substrate 43 and fixed via columns 71 to the resin substrate 43. The radiating element 52 is formed on one of the surfaces of the cover substrate 61 that is closer to the resin substrate 43 on which the feeding element 51 is formed. The feeding element 51 and the radiating element 52 are separated from each other by a space formed by the columns 71. In FIG. 14, the radiating element 52 is represented by a solid line to improve visibility.

Figure 15:
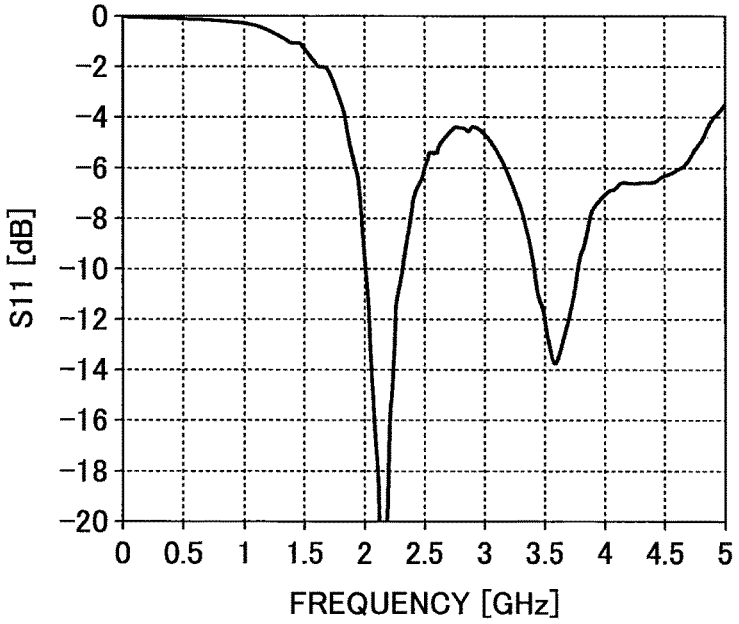
FIG. 15 is a graph illustrating an S11 characteristic of a first example of an antenna device.
Figure 16:
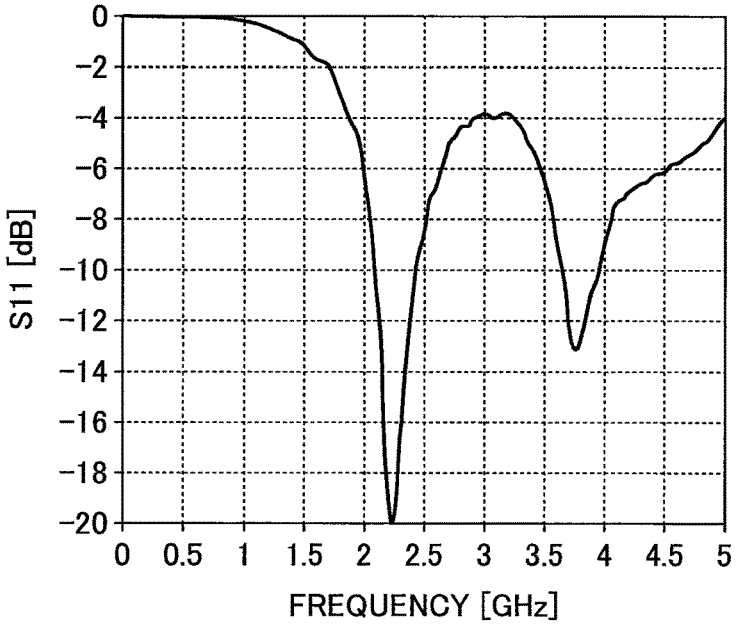
FIG. 16 is a graph illustrating an S11 characteristic of a second example of an antenna device.
Figure 17:
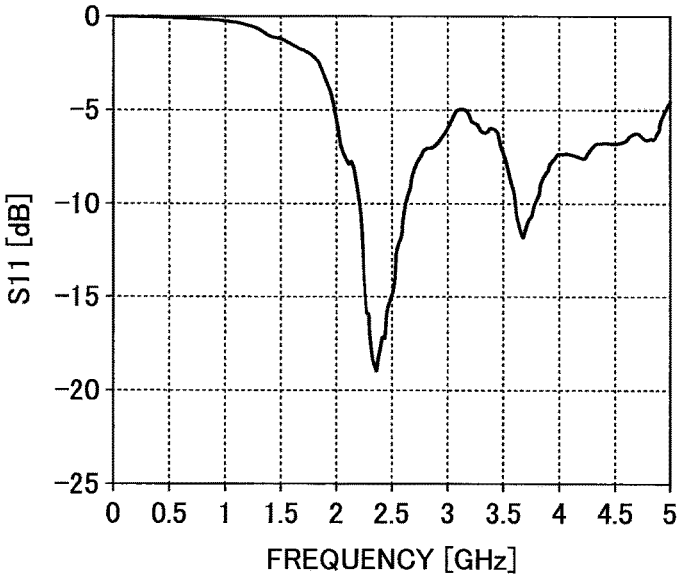
FIG. 17 is a graph illustrating an S11 characteristic of a third example of an antenna device.

FIGS. 15, 16, and 17 are graphs illustrating the S11 characteristic of the radiating element 52 measured by changing materials of the cover substrate 61 of FIGS. 13 and 14. In the measurement, BT resin (registered trademark), CCL-HL870 (M) (MITSUBISHI GAS CHEMICAL COMPANY, INC.) with a relative permittivity of 3.4, tan δ of 0.003, and a substrate thickness of 0.8 mm was used for the resin substrate 43.

FIG. 15 indicates measurement results obtained using RT/duroid 6010 (registered trademark) (Rogers Corporation) with a relative permittivity of 10.2, tan δ of 0.0023, and a substrate thickness of 0.635 mm for the cover substrate 61, and using a copper foil with a thickness of 18 μm for the radiating element 52. Dimensions of the structure in FIG. 14 were set as follows: L11=120 mm, L12=49.15 mm, L3=60 mm, L4=10.95 mm, L5=1.9 mm, W1=86 mm, W2=74.15 mm, W3=28 mm, W4=10.95 mm, W5=1.9 mm, and W6=29 mm.

FIG. 16 indicates measurement results obtained using BT resin (registered trademark), CCL-HL870 (M) (MITSUBISHI GAS CHEMICAL COMPANY, INC.) with a relative permittivity of 3.4, tan δ of 0.003, and a substrate thickness of 0.8 mm for the cover substrate 61, and using a copper foil with a thickness of 18 μm for the radiating element 52. Dimensions of the structure in FIG. 14 were set as follows: L11=120 mm, L12=49.15 mm, L3=60 mm, L4=10.95 mm, L5=1.9 mm, W1=86 mm, W2=74.15 mm, W3=34 mm, W4=10.95 mm, W5=1.9 mm, and W6=26 mm.

FIG. 17 indicates measurement results obtained using aluminosilicate glass (Dragontrail (trademark) of Asahi Glass Co., Ltd.) for the cover substrate 61, and using a copper paste with a resistivity of 18 μΩ/cm for the radiating element 52. The copper paste (composition for conductor) includes copper particles and a resin binder.

Commercial copper particles may be used as the copper particles. Using surface-modified copper particles (Japanese Laid-Open Patent Publication No. 2011-017067) makes it possible to form a conductor film with a low volume resistivity, and is therefore preferable. As the resin binder, any known thermosetting resin used for a metal paste may be used. It is preferably to select a resin component that sufficiently sets at a setting temperature. Examples of thermosetting resin include phenolic resin, diallyl phthalate resin, unsaturated alkyd resin, epoxy resin, urethane resin, bismaleimide triazine resin, silicone resin, and thermosetting acrylic resin. Among them, phenolic resin is particularly preferable.

The amount of thermosetting resin in the copper paste needs to be determined so that the set resin does not reduce the conductivity of the copper particles. When the amount of the set resin is too large, the set resin prevents the copper particles from contacting each other, and increases the volume resistivity of the conductor. The amount of thermosetting resin may be determined based on the ratio between the volume of the copper particles and the gaps between the copper particles. Generally, the amount of thermosetting resin is preferably 5 to 50 parts by mass and more preferably 5 to 20 parts by mass relative to 100 parts by mass of the copper particles. When the amount of thermosetting resin is greater than or equal to 5 parts by mass, the copper paste has a good rheological property. When the amount of thermosetting resin is less than or equal to 50 parts by mass, the volume resistivity of the conductor film can be maintained at a low level.

In the measurement of FIG. 17, dimensions of the structure in FIG. 14 were set as follows: L11=120 mm, L12=49.15 mm, L3=60 mm, L4=10.95 mm, L5=1.9 mm, W1=86 mm, W2=74.15 mm, W3=28 mm, W4=10.95 mm, W5=1.9 mm, and W6=29 mm.

As the results of FIGS. 15, 16, and 17 indicate, regardless of the material of the cover substrate 61, the S11 characteristic of the radiating element 52 was sufficient for the radiating element 52 to function as an antenna.

Figure 18:
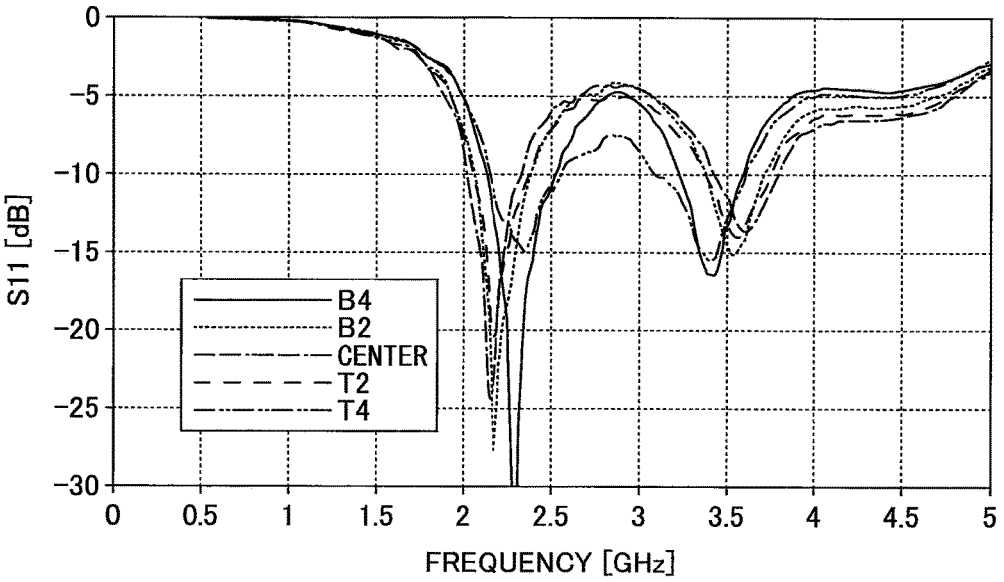
FIG. 18 is a graph illustrating an S11 characteristic indicating positional robustness in a Y-axis direction.
Figure 19:
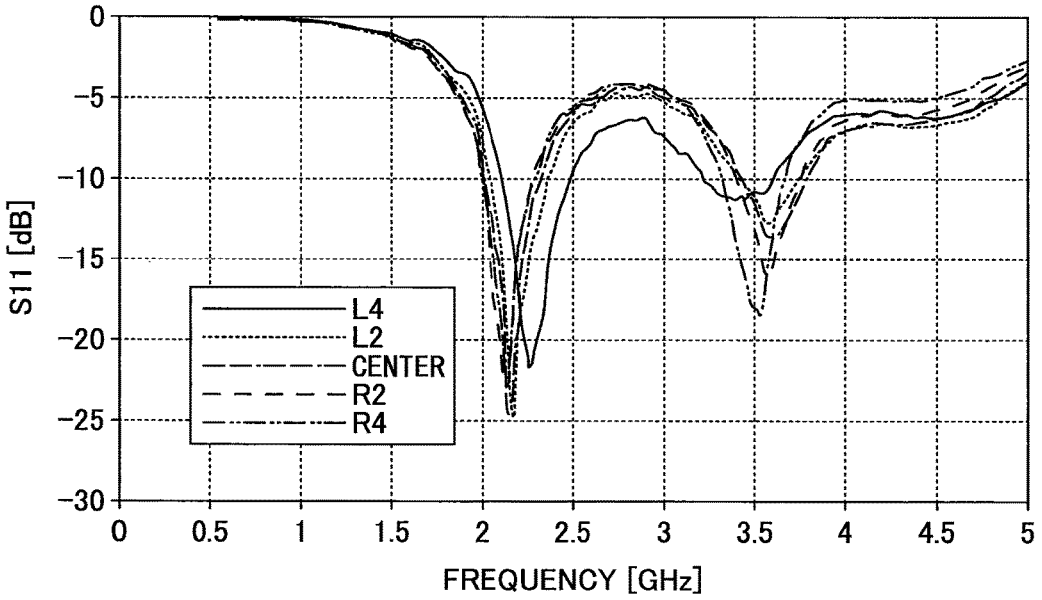
FIG. 19 is a graph illustrating an S11 characteristic indicating positional robustness in an X-axis direction.

FIGS. 18 and 19 are graphs indicating evaluation results of the positional robustness of the antenna device 3. The evaluation results (for five cases) of FIG. 18 were obtained by moving the cover substrate 61 in the upward (TOP) direction and the downward (BOTTOM) direction along the Y-axis in FIG. 14 relative to a design value (center) by a 2-mm pitch, without moving the resin substrate 43 in FIG. 13. In FIG. 18, T2 indicates a case where the cover substrate 61 was moved by 2 mm in the upward (TOP) direction relative to the center, and T4 indicates a case where the cover substrate 61 was moved by 4 mm in the upward (TOP) direction relative to the center. Also, B2 indicates a case where the cover substrate 61 was moved by 2 mm in the downward (BOTTOM) direction relative to the center, and B4 indicates a case where the cover substrate 61 was moved by 4 mm in the downward (BOTTOM) direction relative to the center. The evaluation results (for five cases) of FIG. 19 were obtained by moving the cover substrate 61 in the leftward (LEFT) direction and the rightward (RIGHT) direction along the X-axis in FIG. 14 relative to a design value (center) by a 2-mm pitch, without moving the resin substrate 43 in FIG. 13. In FIG. 19, L2 indicates a case where the cover substrate 61 was moved by 2 mm in the leftward (LEFT) direction relative to the center, and L4 indicates a case where the cover substrate 61 was moved by 4 mm in the leftward (LEFT) direction relative to the center. Also in FIG. 19, R2 indicates a case where the cover substrate 61 was moved by 2 mm in the rightward (RIGHT) direction relative to the center, and R4 indicates a case where the cover substrate 61 was moved by 4 mm in the rightward (RIGHT) direction relative to the center.

Moving the cover substrate 61 results in a change in the positional relationship between the feeding element 51 and the radiating element 52, and it is possible to evaluate how the S11 characteristic of the radiating element 52 changes depending on the change in the positional relationship. As the results of FIGS. 18 and 19 indicate, there is no significant change in the S11 characteristic of the radiating element 52 even when the positional relationship between the feeding element 51 and the radiating element 52 changes. This indicates that the antenna device 3 has high positional robustness.

An antenna device of an embodiment of the present invention can function as a multiband antenna that uses a second-order mode where a radiating element resonates at a resonance frequency that is about two times greater than the resonance frequency of a fundamental mode (first-order mode). Next, conditions in which excellent matching can be achieved in the fundamental mode and the second-order mode of a radiating element of an antenna device of an embodiment when the radiating element operates in the dipole mode are described with reference to an analytic model of FIG. 20.

Figure 20:
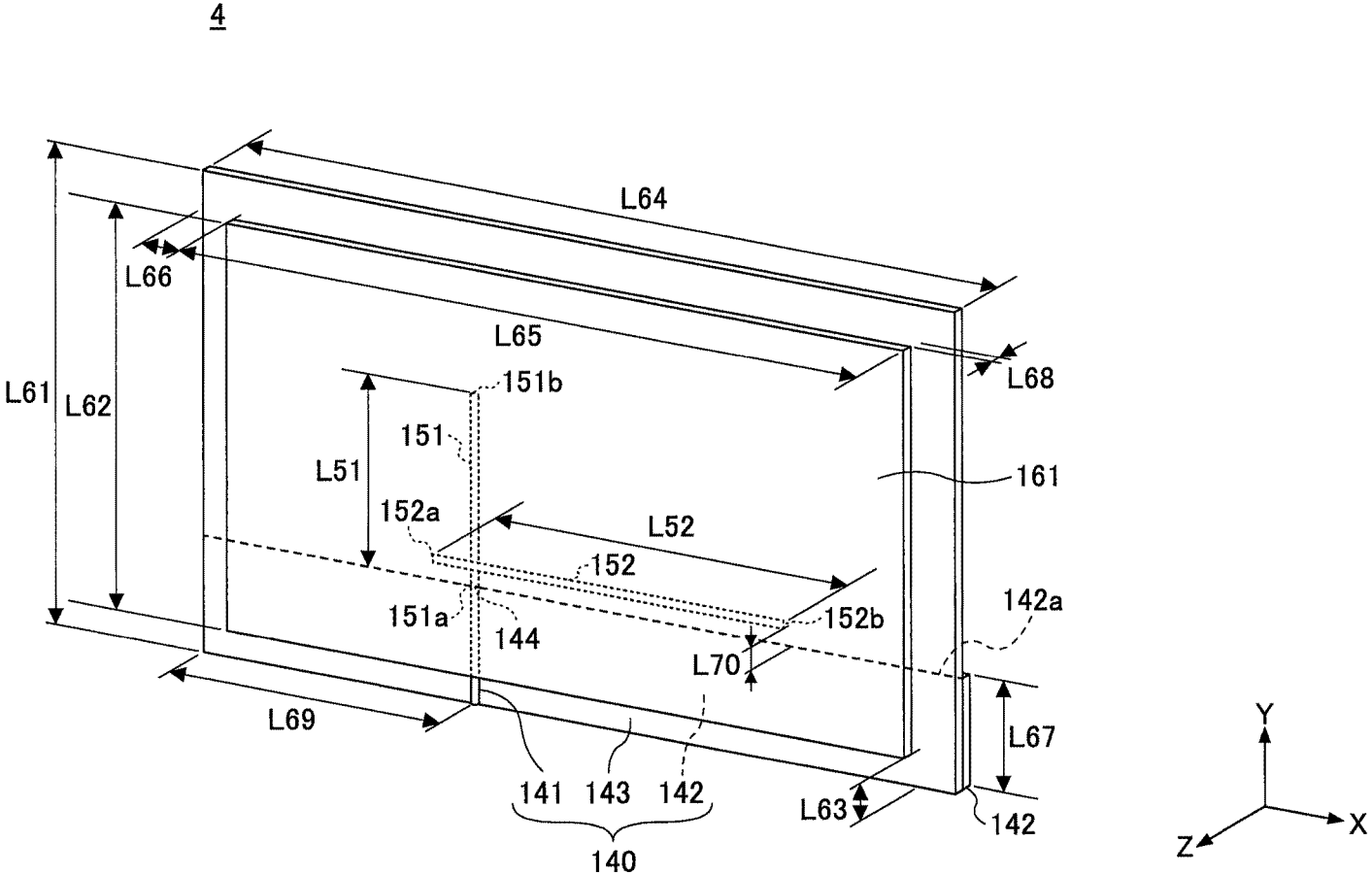
FIG. 20 is a perspective view of an analytic model of an antenna device according to an embodiment.

FIG. 20 is a perspective view of a computer simulation model for analyzing operations of an antenna device 4 according to an embodiment of the present invention. Descriptions of configurations of the antenna device 4 similar to those of the above embodiments may be omitted or simplified. The antenna device 4 includes a feeding element 151 connected to a feed point 144, a radiating element 152 that is coupled with the feeding element 151 by electromagnetic field coupling, and a microstrip line 140 connected to the feed point 144. The feeding element 151 is connected at the feed point 144 to a strip conductor 141 of the microstrip line 140, and therefore the microstrip line 140 practically functions as a feeding line.

The microstrip line 140 includes a substrate 143. A ground plane 142 is formed on one surface of the substrate 143, and the linear strip conductor 141 is formed on the opposite surface of the substrate 143. The feed point 144 is a connection point between the strip conductor 141 and the feeding element 151. It is assumed that an integrated circuit such as an IC chip connected via the microstrip line 140 to the feed point 144 is mounted on the substrate 143.

The feeding element 151 and the strip conductor 141 are disposed on the same surface of the substrate 143. The boundary between the feeding element 151 and the strip conductor 141 is the feed point 144 and coincides with an edge 142*a* of the ground plane 142 in plan view from the Z-axis direction. The feeding element 151 is a linear conductor that extends linearly in the Y-axis direction from an end 151*a* connected to the feed point 144 to an end 151*b*.

Also, the antenna device 4 includes a cover substrate 161 that is disposed at a distance from the substrate 143 in the direction of a normal line of the substrate 143 that is parallel to the Z-axis direction. The radiating element 152 is formed on one of the surfaces of the cover substrate 161 that is closer to the substrate 143 on which the feeding element 151 is formed. The radiating element 152 is a linear conductor that linearly connects an end 152*a* and an end 152*b*.

The radiating element 152 is disposed away from the feeding element 151 in the Z-axis direction such that when seen in the Z-axis direction, the end 152*a* of the radiating element 152 overlaps a portion of the feeding element 151 between the end 151*a* and the end 151*b*. The shortest distance between the feeding element 151 and the radiating element 151 coupled by electromagnetic field coupling corresponds to a gap L68 between the substrate 143 and the cover substrate 161.

Figure 21:
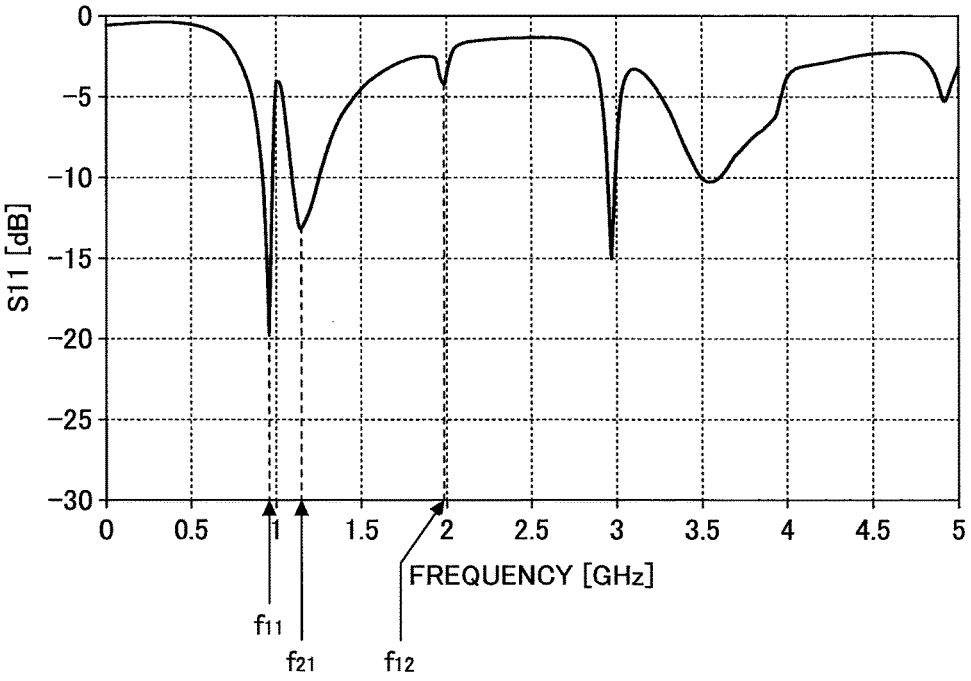
FIG. 21 is a graph illustrating an S11 characteristic of the antenna device of FIG. 20.

FIG. 21 is a graph illustrating the S11 characteristic of the antenna device 4 of FIG. 20. Simulation conditions used to obtain the results of FIG. 21 were as follows: L61=130 mm, L62=110 mm, L63=10 mm, L64=200 mm, L65=180 mm, L66=10 mm, L67=30 mm, L68=2 mm, L69=67.5 mm, and L70=4.05 mm.

Also, the line width of the feeding element 151 was set at a constant value of 1.9 mm, and the line width of the radiating element 152 was set at a constant value of 1.9 mm. As the substrate 143, a dielectric substrate (BT resin (registered trademark), CCL-HL870 (M) (MITSUBISHI GAS CHEMICAL COMPANY, INC.)) with a relative permittivity of 3.4, tan δ of 0.003, and a substrate thickness of 0.8 mm was assumed to be used. As the cover substrate 161, a dielectric substrate (LTCC)) with a relative permittivity of 9.0, tan δ of 0.004, and a substrate thickness of 1.0 mm was assumed to be used.

In FIG. 21, $f_{11}$ indicates a resonance frequency of the fundamental mode of the radiating element 152, $f_{12}$ indicates a resonance frequency of the second-order mode of the radiating element 152, and $f_{21}$ indicates a resonance frequency of the fundamental mode of the feeding element 151. Under the simulation conditions used to obtain the results of FIG. 21, by adjusting a length L51 of the feeding element 151 to 50 mm and a length L52 of the radiating element 152 to 95 mm, the resonance frequency $f_{11}$ of the fundamental mode of the radiating element 152 can be set at 0.97 GHz and the resonance frequency $f_{12}$ of the second-order mode of the radiating element 152 can be set at 1.97 GHz.

With an antenna device of an embodiment of the present invention, the resonance frequency $f_{21}$ of a feeding element can be shifted without changing the resonance frequencies $f_{11}$ and $f_{12}$ of a radiating element, by changing the length of the feeding element with the width of the radiating element fixed. For example, by decreasing the length of the feeding element, the resonance frequency $f_{21}$ of the feeding element can be shifted toward the high-frequency side between the resonance frequencies $f_{11}$ and $f_{12}$ of the radiating element, and can also be shifted to a frequency higher than the resonance frequency $f_{12}$ of the radiating element. On the other hand, by increasing the length of the feeding element, the resonance frequency $f_{21}$ of the feeding element can be shifted toward the low-frequency side, and can also be shifted to a frequency lower than the resonance frequency $f_{11}$ of the radiating element.

Figure 22:
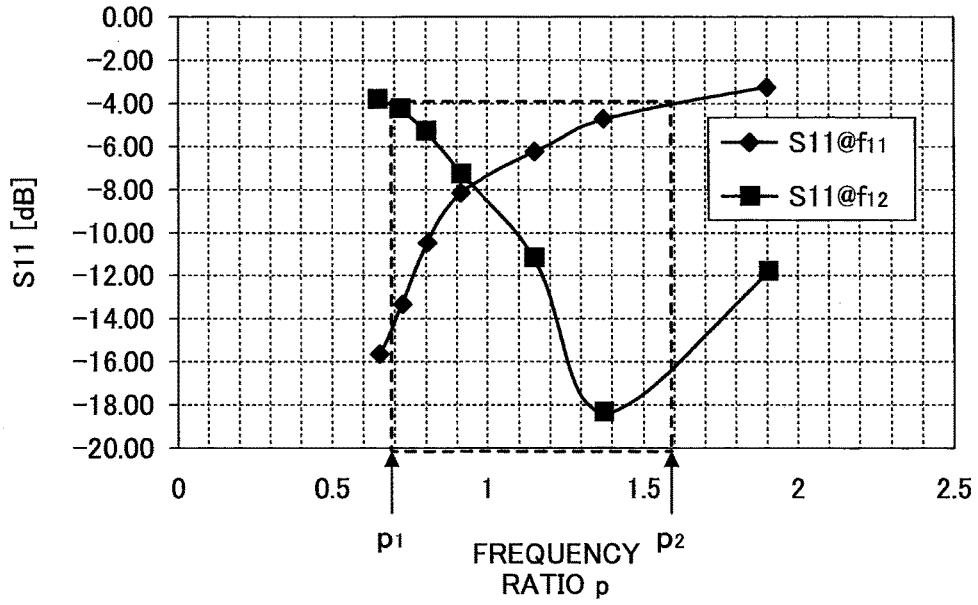
FIG. 22 is a graph illustrating a relationship between a frequency ratio p between a resonance frequency $f_{21}$ of a fundamental mode of a feeding element and a resonance frequency $f_{12}$ of a second-order mode of a radiating element, and an S11 characteristic calculated for each of resonance frequencies $f_{11}$ and $f_{12}$ of the radiating element.

FIG. 22 is a graph illustrating S11 characteristics at the resonance frequencies $F_{11}$ and $f_{12}$ obtained under the simulation conditions of FIG. 21 by decreasing the length L51 of the feeding element 51 by 5 mm from 45 mm to 15 mm with the length L52 of the radiating element 152 fixed at 95 mm. In FIG. 22, the horizontal axis indicates a frequency ratio p between the resonance frequency $f_{21}$ of the fundamental mode of the feeding element 151 and the resonance frequency $f_{12}$ of the second-order mode of the radiating element 152. The frequency ration p is defined by a formula below.

$$p=f_{21}/f_{12}$$

When the frequency ratio p is 1, $f_{12}$ and $f_{21}$ are the same frequency. When the frequency ratio p is less than 1, $f_{21}$ is lower than $f_{12}$. When the frequency ratio p is greater than 1, $f_{21}$ is higher than $f_{12}$. As the length L51 of the feeding element 151 decreases, the resonance frequency $f_{21}$ of the feeding element 151 shifts toward the high-frequency side, and the frequency ratio p increases.

In FIG. 22, the frequency ratio p is less than (i.e., $f_{21}$ is lower than $f_{12}$) when the length L51 of the feeding element 151 is 45 mm, 40 mm, 35 mm, or 30 mm. Also in FIG. 22, the frequency ratio p is greater than 1 (i.e., $f_{21}$ is higher than $f_{12}$) when the length L51 of the feeding element 151 is 25 mm, 20 mm, or 15 mm.

When the S11 characteristic at a resonance frequency of a radiating element satisfies S11<−4 [dB], it is easier to achieve excellent matching of the radiating element. According to the results of FIG. 22, excellent matching can be achieved both in the fundamental mode and the second-order mode of the radiating element 151 when the frequency ratio p is greater than or equal to 0.7 and less than or equal to 1.65. In FIG. 22, a lower limit $p_1$ of the frequency ratio p is 0.7, and an upper limit $p_2$ of the frequency ratio p is 1.65.

FIG. 22 illustrates a case where the length L51 of the feeding element 151 and the length L52 of the radiating element 152 are adjusted, the resonance frequency $f_{11}$ is set at 0.97 GHz, and the resonance frequency $f_{12}$ is set at 1.97 GHz. Although details are omitted, a relationship between the frequency ratio p and S11 at the resonance frequencies $f_{11}$ and $f_{12}$, which is similar to that illustrated by FIG. 22, can be obtained even when the lengths L51 and L52 are adjusted and the resonance frequencies $f_{11}$ and $f_{12}$ are set at other frequencies ($f_{11}$: 1.79 GHz, $f_{12}$: 3.65 GHz; $f_{11}$: 2.51 GHz, $f_{12}$: 5.20 GHz). That is, even when the resonance frequencies $f_{11}$ and $f_{12}$ are set at other frequencies, S11 at the resonance frequencies of the fundamental mode and the second-order mode of the radiating element satisfies S11<−4 [dB] when the frequency ratio p is substantially in the range of greater than or equal to 0.7 and less than or equal to 1.65.

Because the coupling strength of electromagnetic field coupling changes depending on the length of the gap L68 (see FIG. 20), the upper limit $p_2$ of the frequency ratio p, within which S11 at the resonance frequency $f_{11}$ satisfies S11<−4 [dB], also changes depending on the length of the gap L68.

Figure 23:
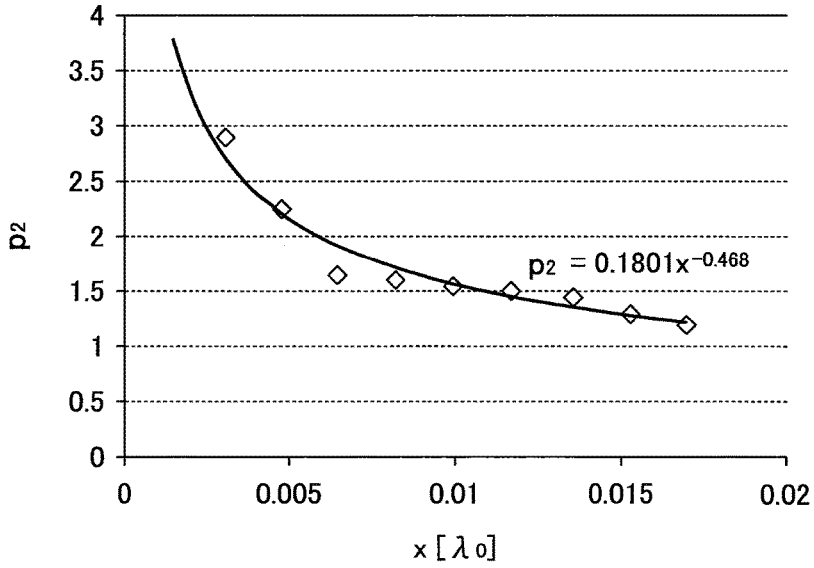
FIG. 23 is a graph illustrating a relationship between an upper limit value p2 of a frequency ratio p and a value x obtained by normalizing a shortest distance between a feeding element and a radiating element.

FIG. 23 is a graph illustrating a change in the upper limit $p_2$ of the frequency ratio p, within which S11 at the resonance frequency $f_{11}$ satisfies S11<−4 [dB], when the gap L68 is increased by 0.5 mm from 1.0 mm to 5.0 mm. Simulation conditions used to obtain the results of FIG. 23 were substantially the same as those used to obtain the results of FIG. 21. In FIG. 23, the horizontal axis indicates a value x (=L68/(c/$f_{11}$)) (where c indicates the speed of light constant) obtained by normalizing the gap L68 by the wavelength $\lambda_0$ in a vacuum at the resonance frequency f11.

According to FIG. 23, the following relational expression is obtained by approximating, according to a least-squares method, a relationship between the upper limit $p_2$ of the frequency ratio p and the value x obtained by normalizing the gap L68 by the wavelength $\lambda_0$.

$$p_2=0.1801\cdot x^{-0.468}$$

Thus, assuming that a resonance frequency of the fundamental mode of the feeding element is $f_{21}$, a resonance frequency of the second-order mode of the radiating element is $f_{12}$, a wavelength in a vacuum at the resonance frequency of the fundamental mode of the radiating element is $\lambda_0$, and a value obtained by normalizing the shortest distance between the feeding element and the radiating element by $\lambda_0$ is x, excellent matching is achieved at the resonance frequency of the fundamental mode and the resonance frequency of the second-order mode of the radiating element when the frequency ration p (=$f_{21}/f_{12}$) is greater than or equal to 0.7 and less than or equal to ($0.1801\cdot x^{-0.468}$).

Figure 24:
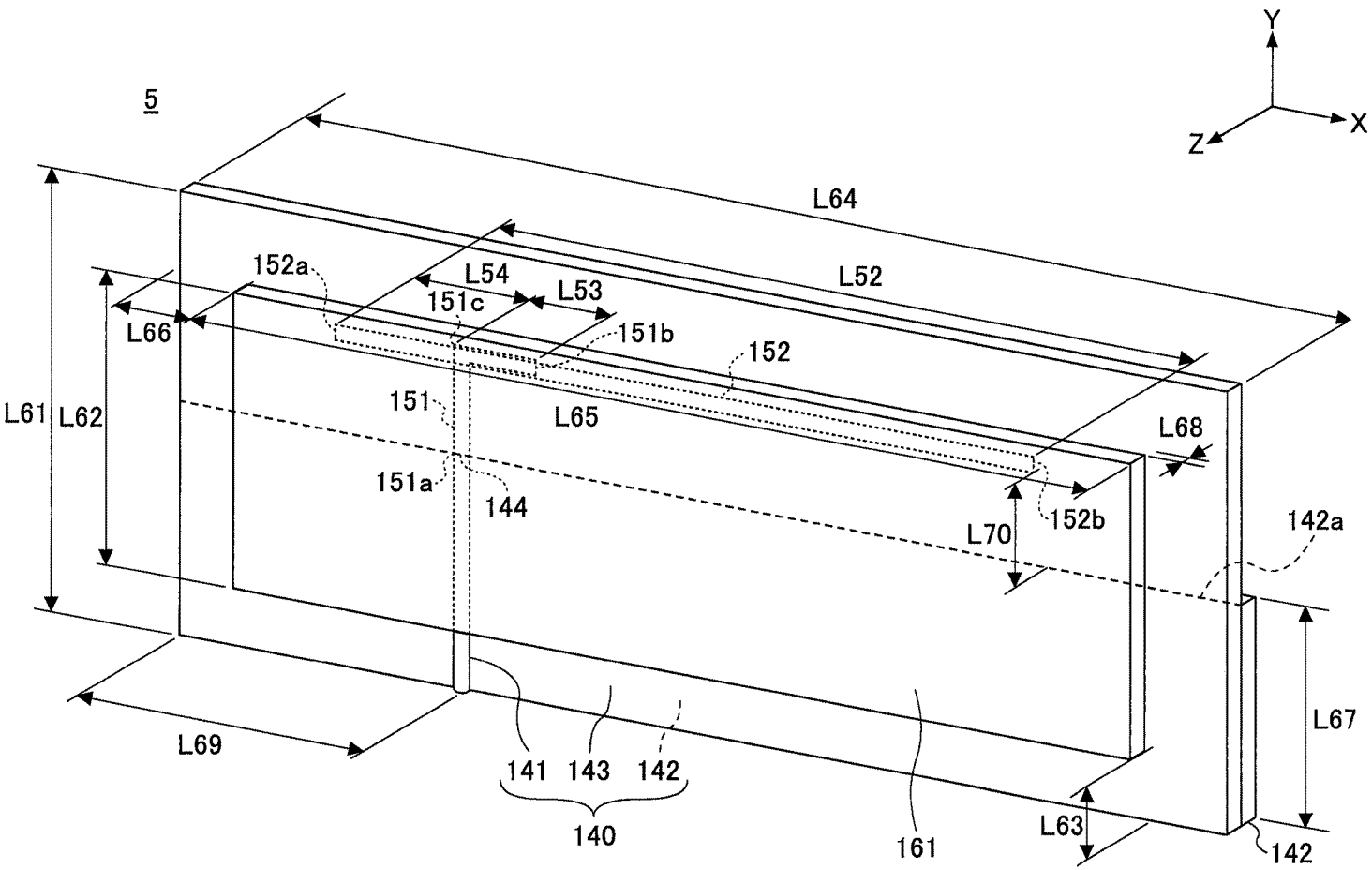
FIG. 24 is a perspective view of an antenna device according to an embodiment.

For example, even when the shape of the feeding element 151 is changed to an L-shape as illustrated in FIG. 24, excellent matching can be achieved both at the resonance frequency of the fundamental mode and the resonance frequency of the second-order mode of the radiating element as long as the frequency ratio p is greater than or equal to 0.7 and less than or equal to ($0.1801\cdot x^{-0.468}$). By forming the feeding element in an L-shape, it is possible to reduce the size of an antenna device.

FIG. 24 is a perspective view of an antenna device 5 according to an embodiment of the present invention. FIG. 24 is obtained by calculating S11 based on a simulation model formed on a computer, and also measuring S11 using an antenna device actually produced. Descriptions of configurations of the antenna device 5 similar to those of the above embodiments may be omitted or simplified. The antenna device 5 includes an L-shaped feeding element 151 connected to a feed point 144, a radiating element 152 that is coupled with the feeding element 151 by electromagnetic field coupling, and a microstrip line 140 connected to the feed point 144.

The feeding element 151 of the antenna device 5 is a linear conductor that bends at a right angle at a bent part 151*c* between an end 151*a* and an end 151*b*. The feeding element 151 includes a linear conductor portion extending in the Y-axis direction between the end 151*a* and the bent part 151*c*, and a liner conductor portion extending in the X-axis direction between the bent part 151*c* and the end 151*b*. The radiating element 152 includes a linear conductor portion that overlaps the linear conductor portion of the feeding element 151 between the bent part 151*c* and the end 151*b* in plan view seen from the Z-axis direction. The bent part 151*c* is located between the end 152*a* and the end 152*b* in plan view seen from the Z-axis direction.

Figure 25:
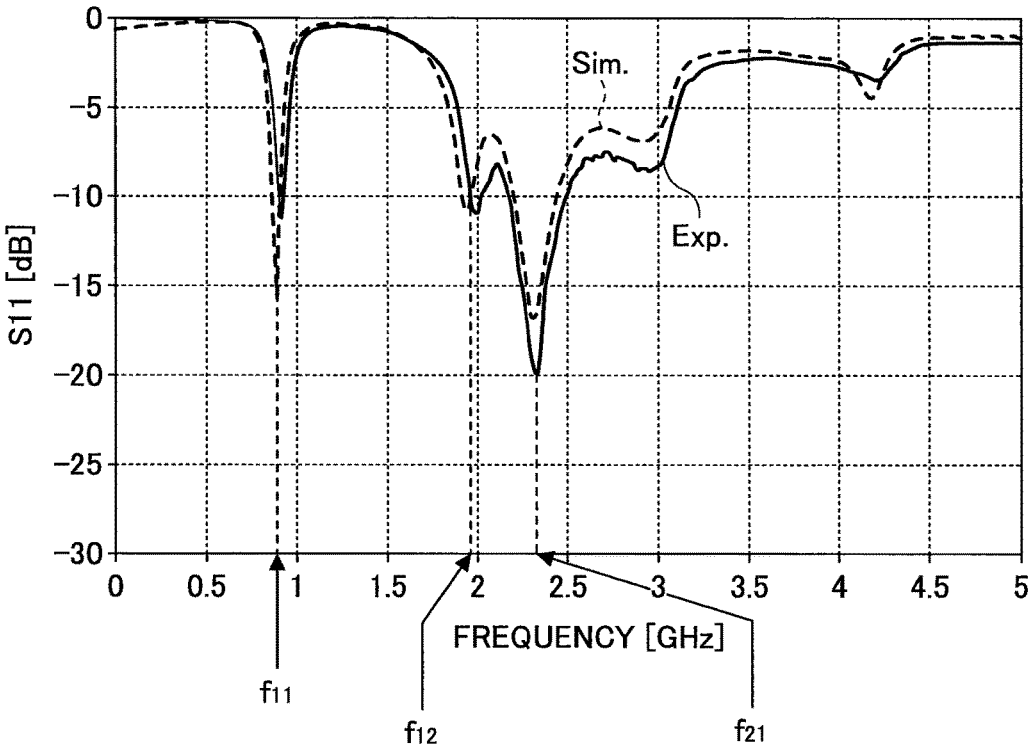
FIG. 25 is a graph illustrating an S11 characteristic of the antenna device of FIG. 24.

FIG. 25 is a graph illustrating the S11 characteristic of the antenna device 5 of FIG. 24. In FIG. 25, "Sim." Indicates S11 analyzed on a computer, and "Exp." Indicates S11 measured using an actually-produced antenna device. Conditions used for the analysis and the measurement of the results of FIG. 25 were as follows: L52=95 mm, L53=10.95 mm, L54=12 mm, L61=60 mm, L62=40 mm, L63=10 mm, L64=140 mm, L65=120 mm, L66=10 mm, L67=30 mm, L68=1 mm, L69=34.5 mm, and L70=14.05 mm.

Also, the line width of the feeding element 151 was set at a constant value of 1.9 mm, and the line width of the radiating element 152 was set at a constant value of 1.9 mm. As the substrate 143, a dielectric substrate (BT resin (registered trademark), CCL-HL870 (M) (MITSUBISHI GAS CHEMICAL COMPANY, INC.)) with a relative permittivity of 3.4, tan δ of 0.003, and a substrate thickness of 0.8 mm was assumed to be used. As the cover substrate 161, a dielectric substrate (LTCC)) with a relative permittivity of 9.0, tan δ of 0.004, and a substrate thickness of 1.0 mm was assumed to be used. The entire length of the feeding element 151 substantially equals to (L70+L53).

As illustrated by FIG. 25, similarly to the simulation results, excellent matching was achieved even using the actually-produced antenna device not only at the resonance frequency $f_{11}$ of the fundamental mode and the resonance frequency $f_{12}$ of the second-order mode of the radiating element, but also at the resonance frequency $f_{21}$ of the fundamental mode of the feeding element.

An antenna device and a wireless apparatus including the antenna device according to the embodiments of the present invention are described above. However, the present invention is not limited to the described embodiments. Combinations of some or all of the embodiments and the variation and replacement of the embodiments may be made without departing from the scope of the present invention.

For example, the feeding element 21 and the radiating element 22 exemplified by FIG. 1A are implemented as linear conductors extending linearly. However, the feeding element 21 and/or the radiating element 22 may be implemented as a linear conductor including a bent conductor portion. For example, the feeding element 21 and/or the radiating element 22 may include an L-shaped conductor portion or a meander-shaped conductor portion. Also, the feeding element 21 and/or the radiating element 22 may be implemented as a linear conductor that branches. Also, a feeding element may include a stub or a matching circuit.

This configuration makes it possible to reduce an area occupied by the feeding element on a substrate.

Figure 26:
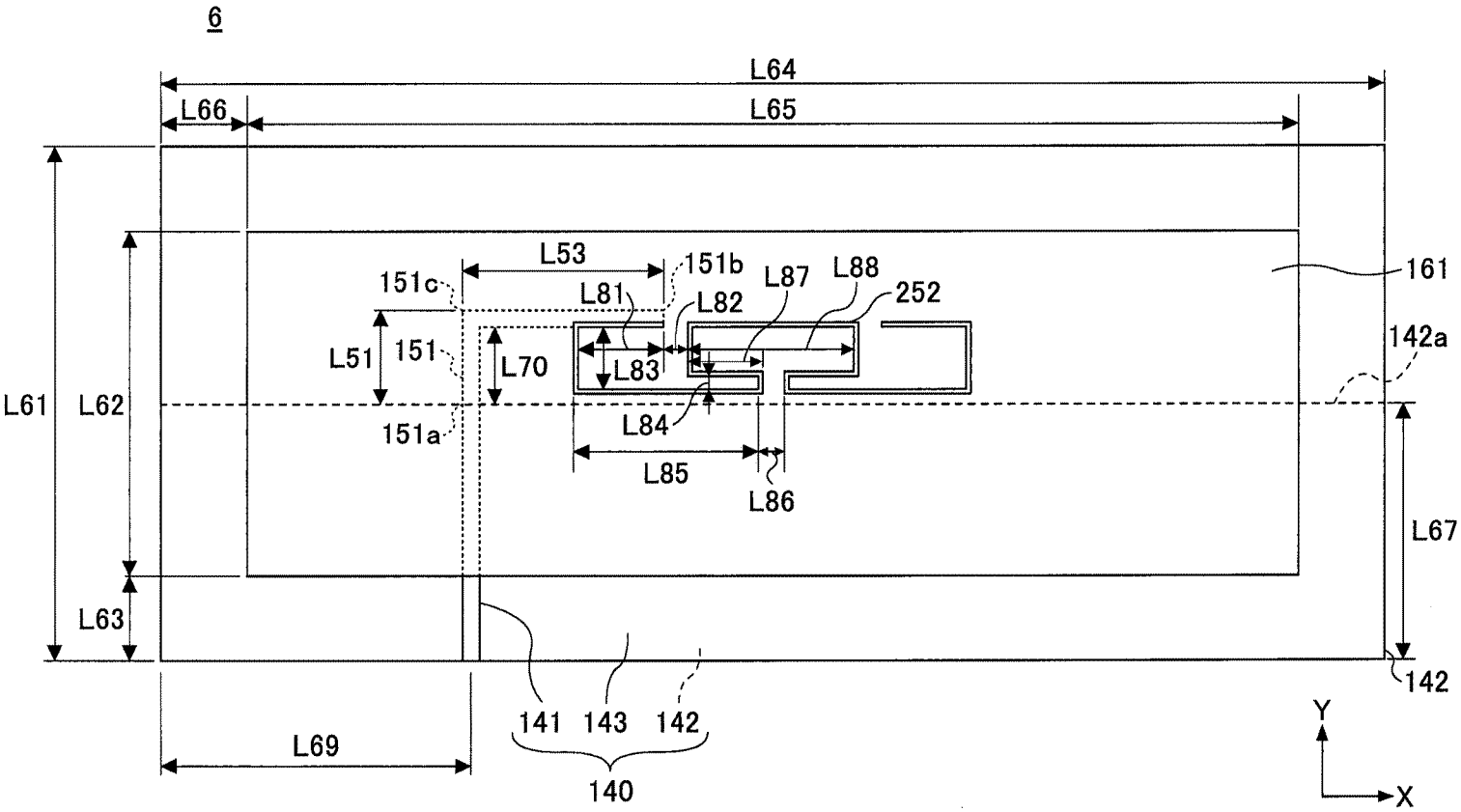
FIG. 26 is a plan view of an analytic model of an antenna device according to an embodiment.

FIG. 26 is a plan view of a computer simulation model for analyzing operations of an antenna device 6 including a meander-shaped radiating element. Descriptions of configurations of the antenna device 6 similar to those of the above embodiments may be omitted or simplified. FIG. 26 exemplifies a radiating element having a meander shape. The antenna device 6 includes a radiating element 252 that is coupled with an L-shaped feeding element 151 by electromagnetic field coupling.

The radiating element 252 has a meander shape that is axisymmetric about a symmetric axis in the Y-axis direction, and includes a linear conductor portion that overlaps a linear conductor portion between a bent part 151*c* and an end 151*b* of the feeding element 151 in plan view seen from the Z-axis direction. The radiating element 252 is formed on one of the surfaces of the substrate 161 that is closer to the substrate 143 on which the feeding element 151 is formed. The entire length of the radiating element 252 is $\lambda/2$. In FIG. 26, the radiating element 252 is represented by a solid line to improve visibility. Alternatively, the radiating element 252 may be implemented as a linear conductor having a point-symmetric meandering shape.

Figure 27:
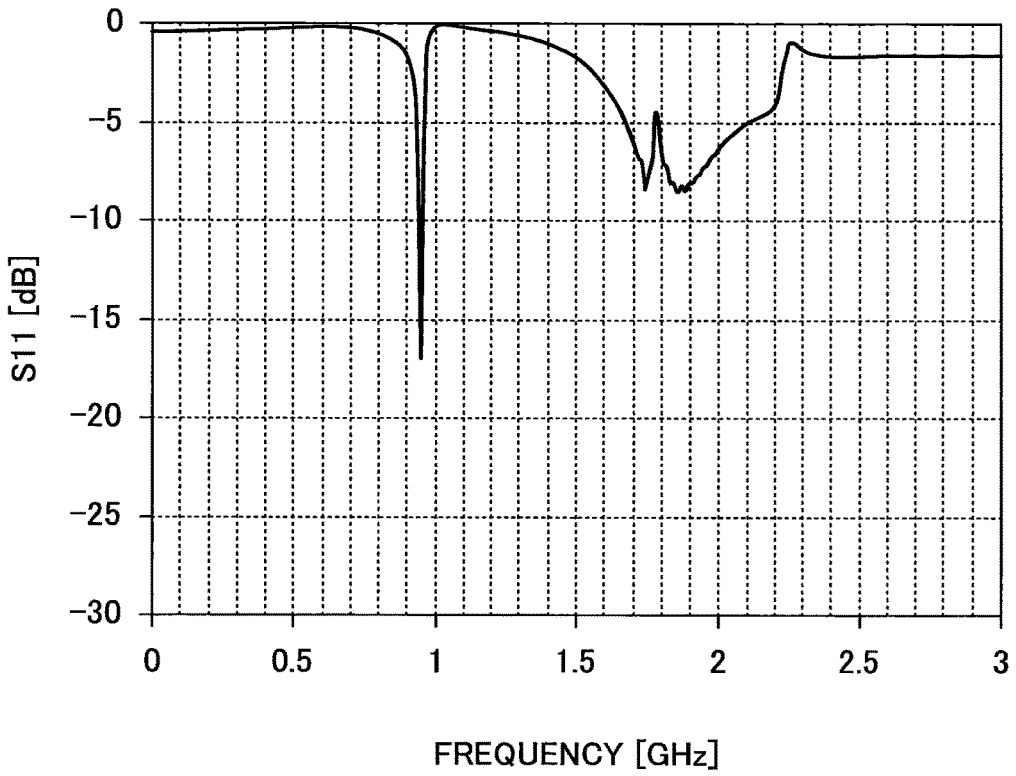
FIG. 27 is a graph illustrating an S11 characteristic of the antenna device of FIG. 26.

FIG. 27 is a graph illustrating the S11 characteristic of the antenna device 6 of FIG. 26. Simulation conditions used to obtain the results of FIG. 27 were as follows: L53=22.95 mm, L61=60 mm, L62=40 mm, L63=10 mm, L64=140 mm, L65=120 mm, L66=10 mm, L67=30 mm, L69=34.5 mm, L70=9.5 mm, L81=9.75 mm, L82=2.75 mm, L83=7.5 mm, L84=1.5 mm, L85=20.5 mm, L86=2.5 mm, L87=8 mm, and L88=18.5 mm. Also, the shortest distance between the feeding element 151 and the radiating element 252 (i.e., a gap between the substrate 143 and the substrate 161) was 2 mm. Also, the line width of the feeding element 151 was set at a constant value of 1.9 mm, and the line width of the radiating element 252 was set at a constant value of 1.9 mm. As the substrate 143, a dielectric substrate (BT resin (registered trademark) of MITSUBISHI GAS CHEMICAL COMPANY, INC.) with a relative permittivity of 3.4, tan $\delta$ of 0.0015, and a substrate thickness of 0.8 mm was assumed to be used. As the substrate 161, a glass plate with a relative permittivity of 7.0 and a substrate thickness of 1.0 mm was assumed to be used. The entire length of the feeding element 151 substantially equals to (L70+L53).

As illustrated by FIG. 27, excellent matching was achieved at the resonance frequency of the fundamental mode and the resonance frequency of the second-order mode of the radiating element.

Figure 28:
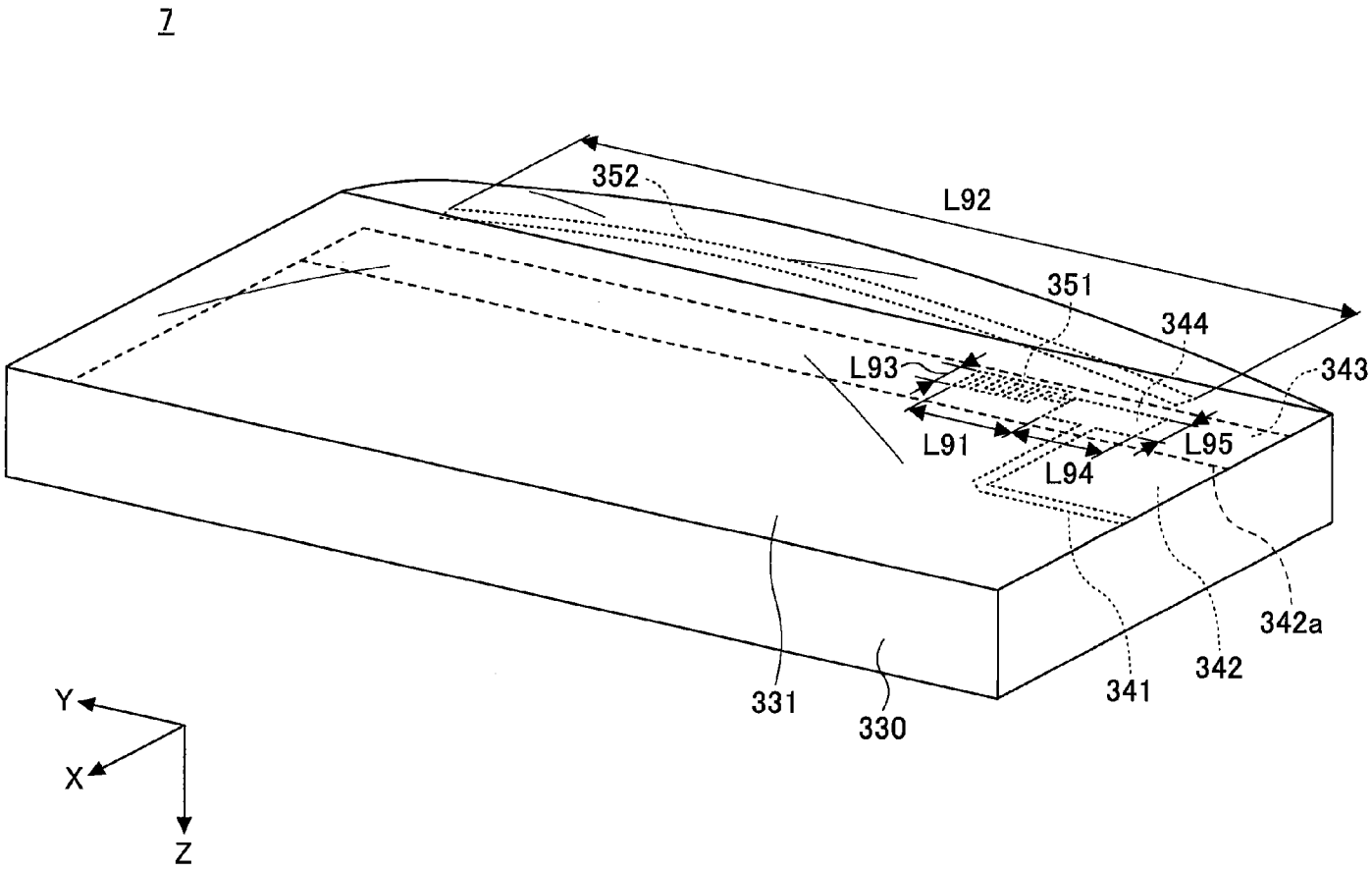
FIG. 28 is a perspective view of a wireless apparatus according to an embodiment.

A radiating element is not necessarily formed on a flat surface. For example, a radiating element may be formed along a curved surface as illustrated by FIG. 28. FIG. 28 is a perspective view of a wireless communication apparatus 7 including a cover glass 331 with a curved surface on which a radiating element 352 is formed.

The wireless communication apparatus 7 has a configuration similar to the configuration of the wireless communication apparatus 2 (see FIG. 6), and is a portable wireless apparatus. The wireless communication apparatus 7 includes a housing 330 and the cover glass 331 that entirely covers an image display surface of a display disposed in the housing 330. An antenna device according to an embodiment of the present invention is housed in the housing 330.

The antenna device housed in the housing 330 includes a resin substrate 343 on which a microstrip line is formed. A ground plane 342 is formed on one surface of the resin substrate 343, and a linear strip conductor 341 is formed on the opposite surface of the resin substrate 343. An edge 342*a* is an edge of the ground plane 342.

The antenna device housed in the housing 330 includes a feeding element 351 connected via a feed point 344 to the strip conductor 341, and a radiating element 352 that is coupled with the feeding element 351 by electromagnetic field coupling. The feeding element 351 and the strip conductor 341 are disposed on the same surface of the resin substrate 343. The feeding element 351 is a meander-shaped linear conductor connected to the feed point 344 that is connected to the strip conductor 341. The radiating element 352 is formed on a recessed surface of the cover glass 331 near the feeding element 351.

Figure 29:
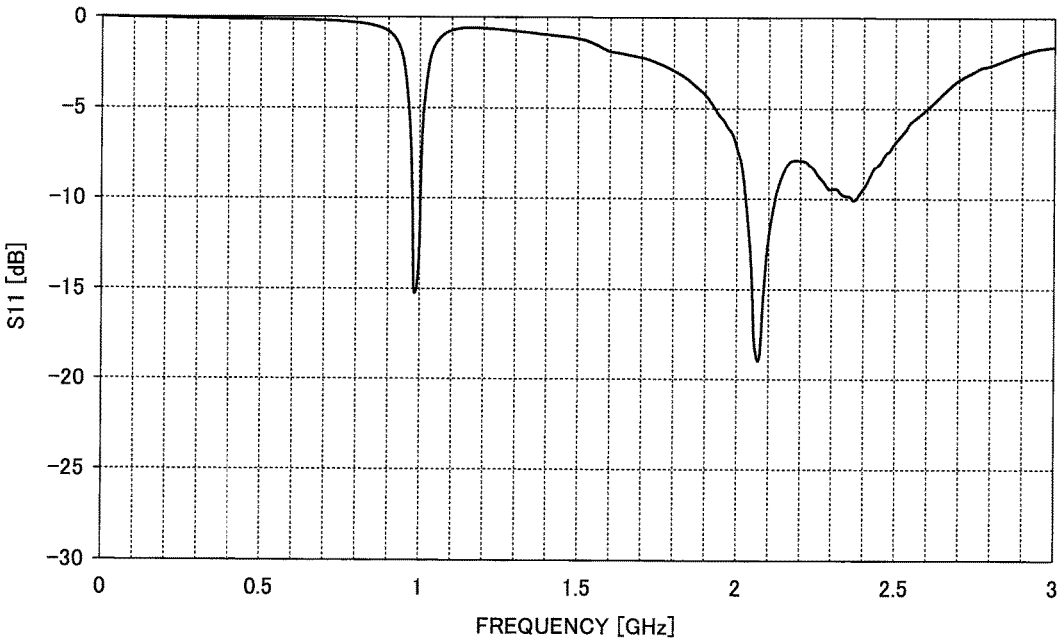
FIG. 29 is a graph illustrating an S11 characteristic of an antenna device installed in the wireless apparatus of FIG. 28.

FIG. 29 is a graph illustrating an S11 characteristic of the antenna device housed in the housing 330 of the wireless communication apparatus 7 of FIG. 28. Conditions used to measure the results of FIG. 29 were as follows: L91=12.5 mm, L92=105 mm, L93=5 mm, L94=11 mm, and L95=5.95 mm.

Also, the line width of the feeding element 351 was set at a constant value of 0.5 mm, the line width of the radiating element 352 was set at a constant value of 2 mm, and the line width of the strip conductor 341 was set at a constant value of 1.9 mm. The cover glass 331 has a curved surface, and has a thickness of 1.1 mm. The cover glass 331 includes a portion with a radius of curvature of 200 mm in the X direction and a portion with a radius of curvature of 2000 mm in the Y direction. The cover glass 331 is attached to a frame of the housing 330.

As illustrated by FIG. 29, excellent matching was achieved at the resonance frequency of the fundamental mode and the resonance frequency of the second-order mode of the radiating element.

A feeding element may be formed on a surface of a substrate or inside of the substrate. Also, a chip component including a feeding element and a medium contacting the feeding element may be mounted on a substrate. This configuration makes it possible to easily mount a feeding element contacting a predetermined medium on a substrate.

A medium contacting a radiating element or a feeding element is not limited to a dielectric material, and may be a magnetic material or a substrate including a mixture of a dielectric material and a magnetic material as a base material. Examples of dielectric materials include resin, glass, glass ceramic, Low-Temperature Co-Fired Ceramics (LTCC), and alumina. A mixture of a dielectric material and a magnetic material may be any material that includes a transition element such as Fe, Ni, or Co and a metal or an oxide including a rare-earth element such as Sm or Nd. Examples of mixtures of a dielectric material and a magnetic material include hexagonal ferrite, spinel ferrite (e.g., Mn—Zn ferrite and Ni—Zn ferrite), garnet ferrite, permalloy, and Sendust (registered trademark).

An aspect of this disclosure provides an antenna device including a non-contact feeding mechanism that is highly robust in terms of the positional relationship between a radiating conductor and a feeding element, and a wireless apparatus including the antenna device.

What is claimed is:

1. An antenna device, comprising:

a ground plane;

a feeding element comprising a first conductor and connected to a feed point; and a radiating element comprising a second conductor and positioned at a coupling distance spaced from the feeding element, wherein the ground plane has an edge extending along the radiating element, the feeding element is extending in a direction away from the ground plane, the feeding element is configured to resonate and couple with the radiating element at the coupling distance by electromagnetic field coupling such that when the feeding element resonates and couples with the radiating element, the radiating element functions as a radiating conductor, and $f_{21}/f_{12}$ is less than or equal to $0.1801 \cdot x^{-0.468}$ where a resonance frequency of a fundamental mode of the feeding element is $f_{21}$, a resonance frequency of a second-order mode of the radiating element is $f_{12}$, a wavelength in a vacuum at a resonance frequency of a fundamental mode of the radiating element is $\lambda_0$, and a value obtained by normalizing a shortest distance between the feeding element and the radiating element by $\lambda_0$ is x.

2. The antenna device as claimed in claim 1, wherein the second conductor of the radiating element includes a conductor portion extending along the edge of the ground plane such that the conductor portion is the closest of the second conductor to the ground plane.

3. The antenna device as claimed in claim 1, wherein the radiating element is formed in a plurality.

4. A wireless apparatus, comprising:

the antenna device of claim 1.

5. The wireless apparatus as claimed in claim 4, further comprising:

a housing comprising a metal part, wherein the radiating element is implemented by a metal forming the metal part of the housing of the wireless apparatus.

6. The wireless apparatus as claimed in claim 4, wherein the wireless apparatus includes the antenna device in a plurality.

7. The wireless apparatus as claimed in claim 6, wherein each of the plurality of antenna devices includes the radiating element in a plurality, and one of the plurality of radiating elements is disposed orthogonal to another one of the radiating elements.

8. The wireless apparatus as claimed in claim 4, further comprising:

an image display unit, wherein the radiating element includes a portion extending along an edge of the image display unit.

9. The wireless apparatus as claimed in claim 4, further comprising:

a second antenna device positioned orthogonal to the radiating element.

10. The antenna device as claimed in claim 1, wherein a resonance current is formed on the feeding element and the ground plane, and the radiating element has a resonance frequency different from a resonance frequency of the feeding element.

11. The antenna device as claimed in claim 1, wherein a resonance frequency of a fundamental mode of the feeding element is higher than a resonance frequency of a fundamental mode of the radiating element.

12. The antenna device as claimed in claim 1, wherein when 1 indicates a wavelength of a resonance frequency of a fundamental mode of the radiating element, an electrical length of the feeding element is less than or equal to $(3/8) \cdot 1$.

13. The antenna device as claimed in claim 1, wherein when 1 indicates a wavelength of a resonance frequency of a fundamental mode of the radiating element, an electrical length of the feeding element is greater than or equal to $(1/8) \cdot 1$.

14. The antenna device as claimed in claim 2, wherein when 1 indicates a wavelength of a resonance frequency of a fundamental mode of the radiating element, an electrical length of the feeding element is less than or equal to $(3/8) \cdot 1$.

15. The antenna device as claimed in claim 2, wherein when 1 indicates a wavelength of a resonance frequency of a fundamental mode of the radiating element, an electrical length of the feeding element is greater than or equal to $(1/8) \cdot 1$.

16. The antenna device as claimed in claim 1, wherein the second conductor of the radiating element is a linear conductor extending along the edge of the ground plane and is positioned to resonate when coupled with the feeding element by the electromagnetic field coupling.

17. The antenna device as claimed in claim 1, wherein the second conductor of the radiating element is a loop conductor extending along the edge of the ground plane and is positioned to resonate when coupled with the feeding element by the electromagnetic field coupling.

18. The antenna device as claimed in claim 10, wherein a resonance frequency of a fundamental mode of the feeding element is higher than a resonance frequency of a fundamental mode of the radiating element.

19. The antenna device as claimed in claim 10, wherein when 1 indicates a wavelength of a resonance frequency of a fundamental mode of the radiating element, an electrical length of the feeding element is less than or equal to $(3/8) \cdot 1$.

20. The antenna device as claimed in claim 10, wherein when 1 indicates a wavelength of a resonance frequency of a fundamental mode of the radiating element, an electrical length of the feeding element is greater than or equal to $(1/8) \cdot 1$.

* * * * *